US012557839B2

(12) United States Patent
Vezina

(10) Patent No.: US 12,557,839 B2
(45) Date of Patent: Feb. 24, 2026

(54) CIGAR CUTTING DEVICE AND METHODS OF CUTTING CIGARS

(71) Applicant: Gary Lee Vezina, Bend, OR (US)

(72) Inventor: Gary Lee Vezina, Bend, OR (US)

( * ) Notice: Subject to any disclaimer, the term of this patent is extended or adjusted under 35 U.S.C. 154(b) by 234 days.

(21) Appl. No.: 18/217,249

(22) Filed: Jun. 30, 2023

(65) Prior Publication Data

US 2024/0000139 A1 Jan. 4, 2024

Related U.S. Application Data

(60) Provisional application No. 63/358,062, filed on Jul. 1, 2022.

(51) Int. Cl.
*A24F 13/26* (2006.01)

(52) U.S. Cl.
CPC ..... *A24F 13/26* (2013.01)

(58) Field of Classification Search
CPC ..... A24F 13/26; A24F 13/24; A24F 13/20; A01G 3/04; A01G 3/02; A01G 2/10
USPC ..... 30/113, 304, 379.2, 111, 232, 241, 356, 30/109; 83/13; 131/248, 253, 233, 329; D27/100, 101, 163–169, 172, 175
See application file for complete search history.

(56) References Cited

U.S. PATENT DOCUMENTS

| | | | | |
|---|---|---|---|---|
| 519,332 | A * | 5/1894 | Hopkins | A24F 13/26 30/113 |
| 2,704,000 | A * | 3/1955 | Miller | H02G 1/1229 30/91.2 |
| 4,805,302 | A * | 2/1989 | Steiner | H02G 1/1224 30/90.1 |
| 5,715,602 | A * | 2/1998 | Hage | A24F 13/26 30/113 |
| 10,736,353 | B1 * | 8/2020 | Sharp | A24F 13/26 |
| 2023/0255261 | A1 * | 8/2023 | Lo | A24F 13/26 30/113 |

* cited by examiner

*Primary Examiner* — Ghassem Alie
(74) *Attorney, Agent, or Firm* — Polsinelli PC

(57) ABSTRACT

A cigar cutting device is provided. In some examples, the cigar cutting device can include a body defining an opening for receiving at least a portion of a cigar. The cigar cutting device can also include a cutter portion coupled to the body and including a blade that can cut the cigar. The cutter portion can be adjustable between a first position, where the blade is spaced apart from the opening of the body, and a second position, where the blade is configured to cut the cigar. The cigar cutting device can also include a cradle movably coupled to the cutter portion and defining a receiving portion for facilitating alignment of the cigar. The cradle can be adjustable between a first position and a second position. The cutter portion can be configured to adjust the cradle into the first position when the cutter portion is adjusted into the first position.

11 Claims, 23 Drawing Sheets

CIGAR CUTTING DEVICE AND METHODS OF CUTTING CIGARS

CROSS-REFERENCES TO RELATED APPLICATIONS

This application claims the benefit of U.S. Provisional Application No. 63/358,062, filed Jul. 1, 2022, the disclosure of which is expressly incorporated herein by reference in its entirety.

BACKGROUND

Cigar cutting is an art. The object of a cigar cut is to create an ample, smooth opening for smoking without damaging the cigar's structure. With most cigars, a good cut is achieved by evenly cutting away part of the cap on the head that closes the cigar, while maintaining (and not tearing) the wrapper around the filler leaves. A bad cut can ruin the best of cigars.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a cigar cutting device is provided. The cigar cutting device includes: a body defining an opening for receiving a shoulder of a cigar, the body including a cradle having at least a first cradle portion adjacent the opening to facilitate alignment of the received cigar; and a cutter portion configured to move relative to the body and having a cutting blade configured to cut a portion of the shoulder of the received cigar.

In accordance with another embodiment of the present disclosure, a cigar cutting device is provided. The cigar cutting device includes: a body defining an opening for receiving a shoulder of a cigar, the body including a first cradle portion adjacent the opening to facilitate alignment of the received cigar; a second cradle portion moveable between a retracted and an extended position, wherein when the second cradle portion is in an extended position, it is adjacent the received cigar, and wherein the first and second cradle portions facilitate alignment of the cigar such that a longitudinal axis of the cigar is oriented perpendicular to a plane defined by the opening; and a cutter portion configured to move relative to the body and having a cutting blade configured to cut a portion of the shoulder of the cigar when the received cigar is disposed within the opening of the body.

In accordance with another embodiment of the present disclosure, a cigar cutting device is provided. The cigar cutting device includes: a body defining an opening for receiving a shoulder of a cigar, wherein the opening has a first end and a second end; a cutter portion configured to move relative to the body and having a cutting blade configured to cut a portion of the shoulder of the cigar when the received cigar is disposed within the opening of the body; and a stop at the second end of the opening configured to resist insertion of the shoulder of the cigar beyond a set distance into the opening to facilitate the cut at a constant location on the shoulder of the cigar.

In accordance with another embodiment of the present disclosure, a cigar cutting device is provided. The cigar cutting device includes: a body defining an opening for receiving a shoulder of a cigar, the body including a level to facilitate alignment of the received cigar; and a cutter portion configured to move relative to the body and having a cutting blade configured to cut a portion of the shoulder of the cigar when the received cigar is disposed within the opening of the body.

In accordance with another embodiment of the present disclosure, a cigar cutter is provided. The cigar cutting device can include a body defining an opening for receiving at least a portion of a cigar; a cutter portion coupled to the body and including a blade configured to cut the cigar, wherein the cutter portion is adjustable between a first position, where the blade is spaced apart from the opening of the body, and a second position, where the blade is configured to cut the cigar; and a cradle movably coupled to the cutter portion and defining a receiving portion for facilitating alignment of the cigar, wherein the cradle is adjustable between a first position, where the receiving portion is at a first width, and a second position, where the receiving portion is at a second width, wherein the second width is less than the first width, and wherein the cutter portion is configured to adjust the cradle into the first position when the cutter portion is adjusted into the first position.

In accordance with another embodiment of the present disclosure, a cigar cutting device is provided. The cigar cutter can include a cradle having a first portion coupled to a second portion for facilitating alignment of a cigar, wherein the first and second portions define an opening; and a cutter portion coupled to the cradle and including a blade configured to cut the cigar, wherein the cutter portion is adjustable between a first position, where the blade is spaced apart from the opening, and a second position where the blade is configured to cut the cigar, wherein the distance between the first and second portions of the cradle when the cutter portion is in the first position is greater than the distance between the first and second portions of the cradle when the cutter portion is in the second position.

In accordance with another embodiment of the present disclosure, a method of using a cigar cutting device is provided. The method can include positioning a cutter portion of the cigar cutter in a first position, where the cigar cutter includes: a body defining an opening for receiving at least a portion of a cigar; the cutter portion coupled to the body and including a blade configured to cut the cigar, wherein the cutter portion is adjustable between a first position, where the blade is spaced apart from the opening of the body, and a second position, where the blade is configured to cut the cigar; and a cradle movably coupled to the cutter portion and defining an opening for facilitating alignment of the cigar, wherein the cradle is adjustable between a first position, where the opening of the cradle is at a first width, and a second position, where the opening of the cradle is at a second width, wherein the second width is less than the first width, and wherein the cutter portion is configured to adjust the cradle into the first position when the cutter portion is adjusted into the first position. The method can also include inserting a cigar into the opening of the body; and adjusting the cutter portion from the first position to the second position to cut the cigar.

In any of the embodiments described herein, the first cradle portion can be configured to facilitate the alignment of the cigar such that a longitudinal axis of the cigar is oriented perpendicular to a surface defined by the opening.

In any of the embodiments described herein, the cutting blade can slidably move relative to the body portion.

In any of the embodiments described herein, the cradle can include a second cradle portion.

In any of the embodiments described herein, the second cradle portion can be moveable between a first position and a second position.

In any of the embodiments described herein, the second position can be a position adjacent the received cigar.

In any of the embodiments described herein, the first cradle portion and the second cradle portion in the second position can facilitate alignment of the cigar such that a longitudinal axis of the cigar is oriented perpendicular to a plane defined by the opening.

In any of the embodiments described herein, the first cradle portion can surround at least a portion of the opening.

In any of the embodiments described herein, the first cradle portion can include at least one surface adjacent the opening perpendicular to a plane defined by the opening.

In any of the embodiments described herein, the first cradle portion can include one or more surfaces adjacent the opening perpendicular to a plane defined by the opening.

In any of the embodiments described herein, the second cradle portion in the second position can surround at least a portion of the opening.

In any of the embodiments described herein, the second cradle portion in the second position can include at least one surface adjacent the opening perpendicular to a plane defined by the opening.

In any of the embodiments described herein, the second cradle portion in the second position can include one or more surfaces extending from the body adjacent the opening.

In any of the embodiments described herein, the opening can have a first end and a second end. The first end can be a receiving end and the second end can be a stop end having a stop.

In any of the embodiments described herein, the stop can be configured to be removably coupled to the body.

In any of the embodiments described herein, the stop can be configured to resist insertion of the shoulder of the cigar beyond a set distance into the opening to facilitate the cut at a constant location on the shoulder of the cigar.

In any of the embodiments described herein, the cigar device can further include a level.

In any of the embodiments described herein, the cutter portion can include a first shoulder and the cradle can include a second shoulder, the first shoulder being configured to interface with a second shoulder when the cutter portion is in the first position.

In any of the embodiments described herein, the first shoulder of the cutter portion can be spaced apart from the second shoulder of the cradle when the cutter portion is in the second position.

In any of the embodiments described herein, the receiving portion of the cradle can be defined by at least three sides.

In any of the embodiments described herein, the receiving portion of the cradle can form a quadrilateral shape.

In any of the embodiments described herein, the cigar cutting device can further include a biasing member coupled to the cutter portion, wherein the biasing member can be configured to bias the cutter portion into the first position.

In any of the embodiments described herein, the biasing member can be a first biasing member and the cigar cutting device can further include a second biasing member coupled to the cradle, wherein the second biasing member can be configured to bias the cradle into the second position.

In any of the embodiments described herein, the biasing member can be a first biasing member and the cigar cutting device can further include a second biasing member coupled to the cradle, wherein the second biasing member can be configured to bias the first portion of the cradle towards the second portion of the cradle.

In any of the embodiments described herein, the cigar cutting device can further include a stop removably coupled to the body, wherein the stop defines an end of the opening of the body.

In any of the embodiments described herein, the cutter portion can include a first shoulder and the first portion of the cradle can include a second shoulder, wherein the first shoulder can be configured to interface with the second shoulder when the cutter portion is in the first position.

In any of the embodiments described herein, the first shoulder of the cutter portion can be spaced apart from the second shoulder of the first portion of the cradle when the cutter portion is in the second position.

In any of the embodiments described herein, the opening of the cradle can be defined by at least three sides.

In any of the embodiments described herein, the opening of the cradle can form a quadrilateral shape.

In any of the embodiments described herein, the cutter portion can include a first shoulder and the cradle includes a second shoulder, the first shoulder being configured to interface with second shoulder when the cutter portion is in the first position.

In any of the embodiments described herein, positioning the cutter portion of the cigar cutter in the first position can include interfacing the first shoulder of the cutter portion with the second shoulder of the cradle.

In any of the embodiments described herein, the first shoulder of the cutter portion can be spaced apart from the second shoulder of the cradle when adjusting the cutter portion from the first position to the second position.

In any of the embodiments described herein, the cradle is configured to press against at least a portion of the cigar when adjusting the cutter portion from the first position to the second position.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Embodiments of the present disclosure are directed to cigar cutters having a cutting device and a mechanism for aiding in a level cut, for example, a cigar cutter including a cradle 115 (see, e.g., FIG. 3B), a stop 154 (see, e.g., FIG. 9B), and/or a level indicator 210 (see, e.g., FIGS. 11A-11I). Other embodiments of the present disclosure are directed to methods of using a cigar cutter as described herein.

Figure 1A:
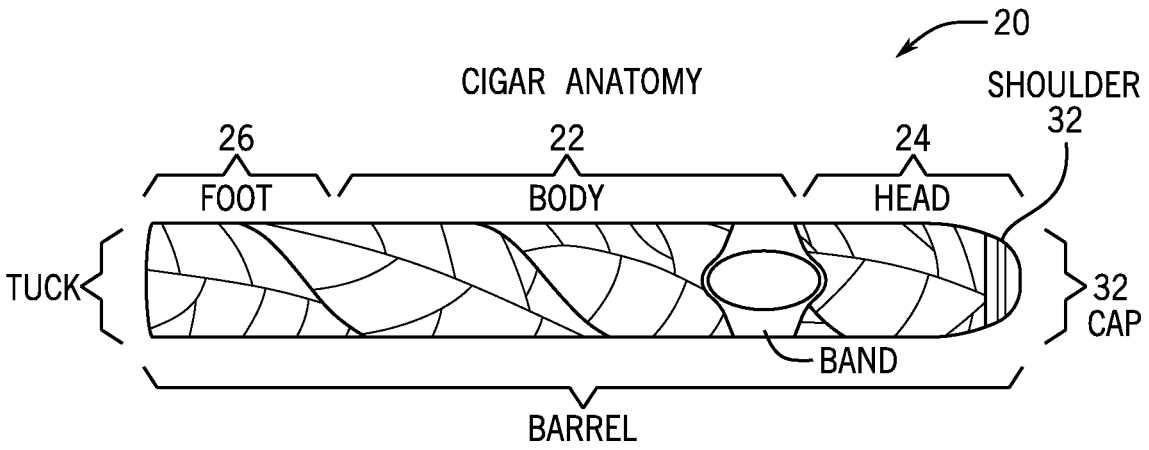
FIG. 1A is a schematic illustrating the anatomy of a cigar.
Figure 1B:
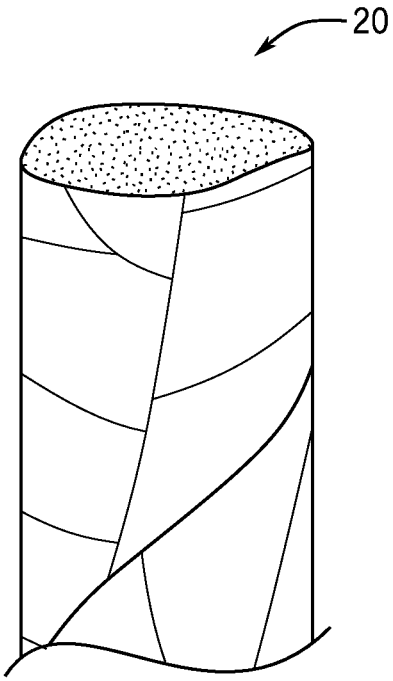
FIG. 1B is a drawing of a cigar having a substantially level cut.
Figure 1C:
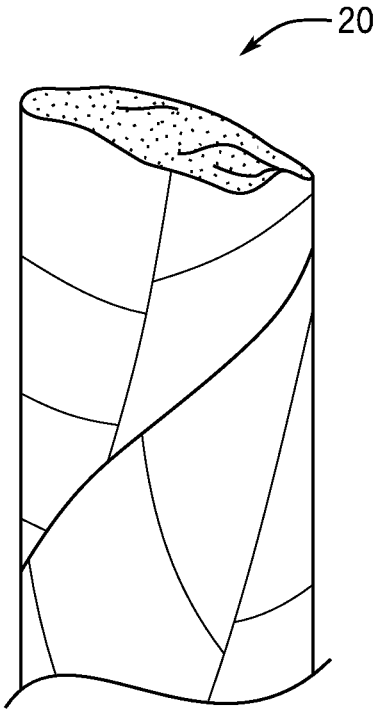
FIG. 1C is a drawing of a cigar with an undesirable angled cut.

A problem exists with conventional cigar cutters of all types in that handheld cigar cutters do not allow a user to ensure a cut that is precisely perpendicular to the end, or cap, of a cigar. Furthermore, the cut may vary between different cigars even though the cigar type and the cutter are the same. This angled cut and variability affects the consistency and quality of experience of a cigar smoker. The cigar cutter 100 disclosed herein provides solutions that remedy this problem. FIG. 1A illustrates cigar anatomy, and FIGS. 1B and 1C illustrate, respectively, a substantially level cut and an undesirable angled cut.

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. It will be appreciated that embodiments of the present disclosure may employ any combination of features described herein.

As used herein, the terms "generally," "substantially," "about," and similar terms are used as terms of approximation and not as terms of degree, and are intended to account for the inherent variations in measured or calculated values that would be recognized by those of ordinary skill in the art. Language such as "top", "bottom", "vertical", "horizontal", "lateral", "front", "rear", "sides" etc. in the present disclosure is meant to provide orientation for the reader with reference to the drawings and is not intended to be the required orientation of the components or to impart orientation limitations into the claims Referring to FIG. 1A, a cigar 20 is generally made with a body 22 having a head end 24 on one end of the body 22, and a foot end 26 on the opposite end. The foot end 26 is typically an open end that is where one lights the cigar. The head end 24 typically includes a shoulder 30 and a cap 32 and is the end that is usually placed in a user's mouth. The cigar 20 is filled with tobacco leaf fill, which is surrounded by a binder (which is an outer cover leaf) and a wrapper.

To start smoking the cigar 20, the cap 32 is cut to expose the fill inside, and the foot end 26 is lit by the user. The goal in making the cut at the cap 32 is to create a smooth, level opening without compromising the integrity of the cigar 20. See cut examples in FIGS. 1B and 1C.

Cigar cutting devices in accordance with embodiments of the preset disclosure may be used in conjunction with various types of cigars. The cigar 20 in the illustrated embodiment of FIG. 1A is a corona-type cigar. Other types of cigars with which cigar cutting devices 20 of the present disclosure may be used include, but are not limited to, pyramid, torpedo, perfecto, panatela, and culebra cigars.

Figure 2:
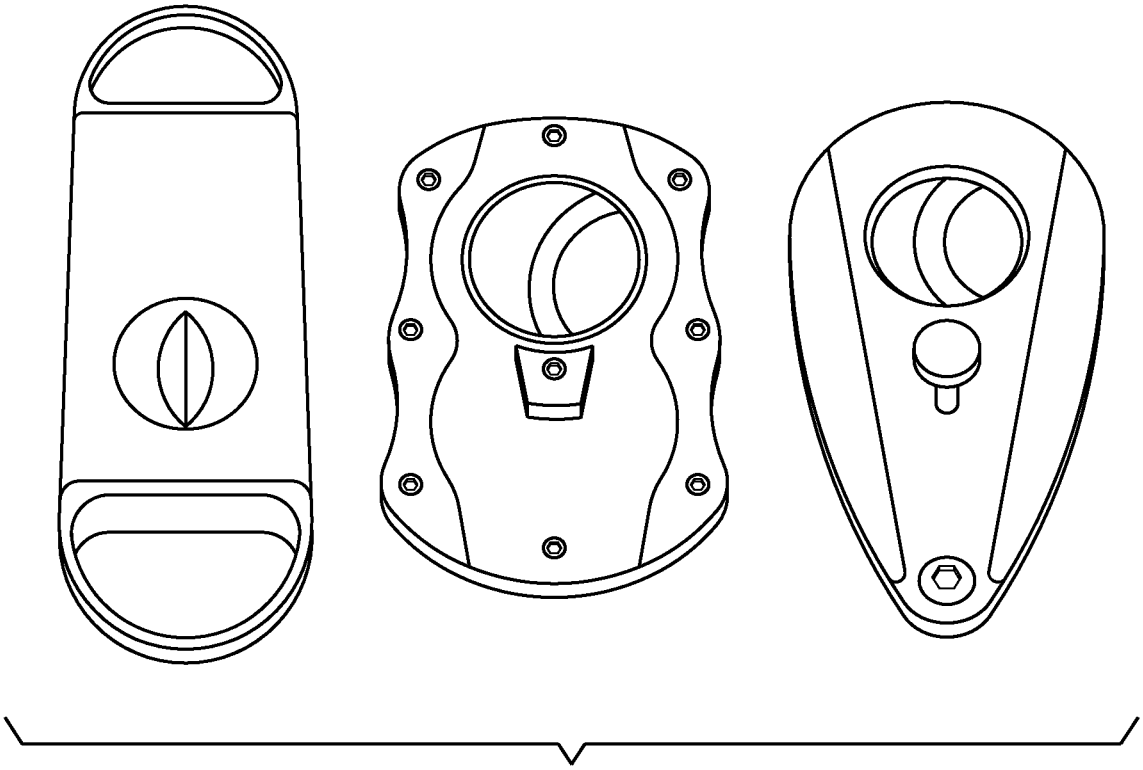
FIG. 2 is a drawing illustrating different types of cigar cutters.

Referring to FIG. 2, different varieties of cigar cutters are illustrated, including but not limited to single- and double-bladed cutters, scissors, and v-cutters. A single-bladed guillotine is the most basic type of straight cigar cap cutter. A double-bladed cutter is designed to make a cut across the cigar from both sides simultaneously. Double-bladed cutters can reduce the risk of tearing the cigar wrapper. In addition to straight cutters, specifically designed scissors for cigar-cutting include blades typically made from high quality stainless steel to effect a clean cap cut.

Instead of cutting off the head completely, a V-cutter can be used to make a notched hole made by a uniquely shaped blade. Similar to the V-cutter (or wedge cutter), a punch does not completely cut the cap off. Instead, it creates a hole in the cap using a sharp, circular blade which creates an opening. A Shuriken cutter is like a giant capsule with six sharp blades to cut a plurality of slits around the cap of the cigar.

The cigar cutting devices disclosed herein may utilize any variety of cigar cutter known in the art. For example, the disclosure herein may apply to any variety of cigar cutter such as a single-blade cutter, scissors, V-cutters, or the like.

Referring generally to FIGS. 3A-9B, various features of a cigar cutting device 100 in accordance with one embodiment of the present disclosure (also referred to as a cigar cutter 100) are shown. The cigar cutter 100 is shown as a single-blade cutter. However, the features of the cigar cutter 100 may also apply to any variety of cigar cutter. In that regard, any variety of cigar cutter having the features disclosed herein regarding the cigar cutter 100 are within the scope of the present disclosure.

Figure 3A:
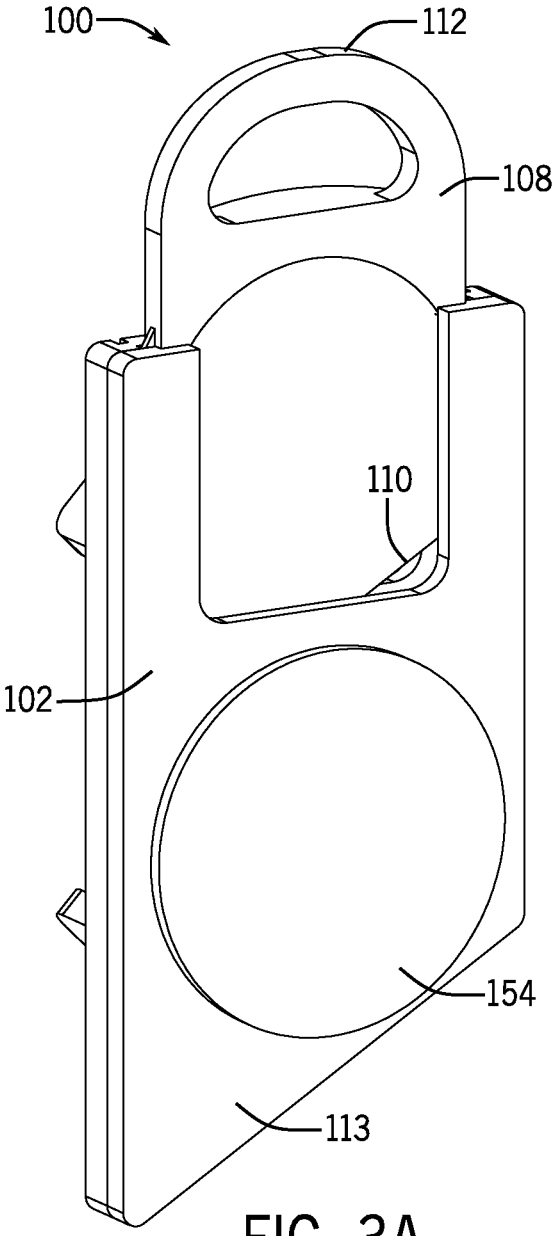
FIGS. 3A and 3B are respective rear and front isometric views of a cigar cutter having various features for providing a level cut of a cigar at a constant location along the cigar in accordance with various embodiments of the present disclosure.
Figure 3B:
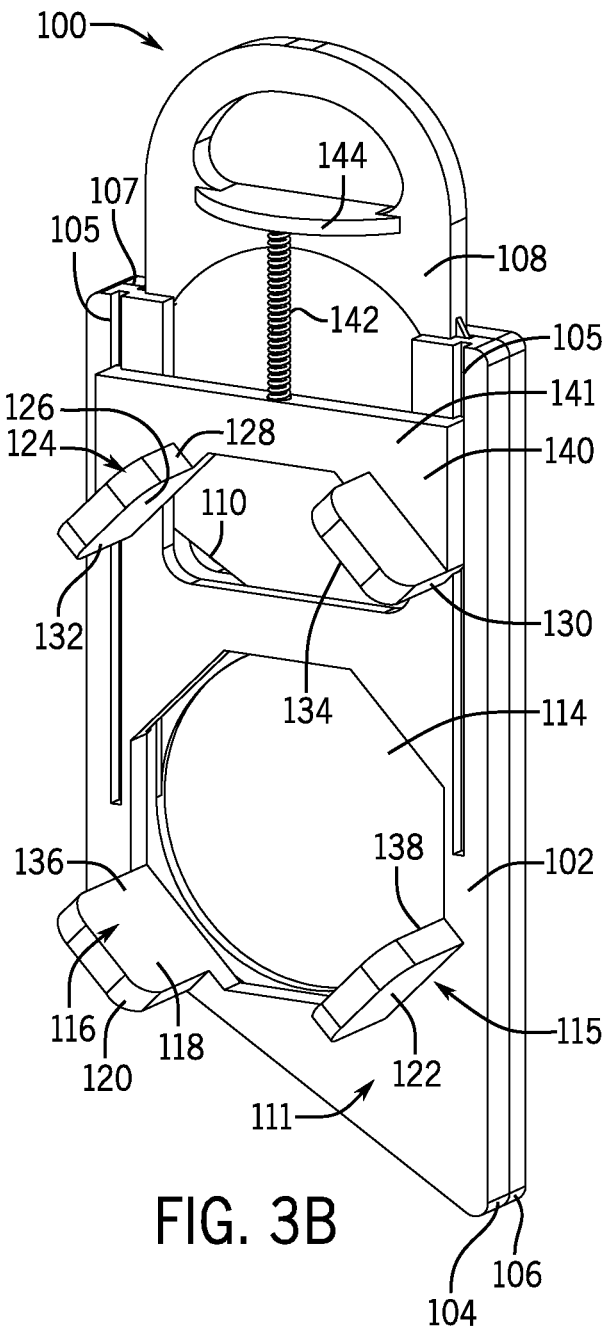
Figure 4A:
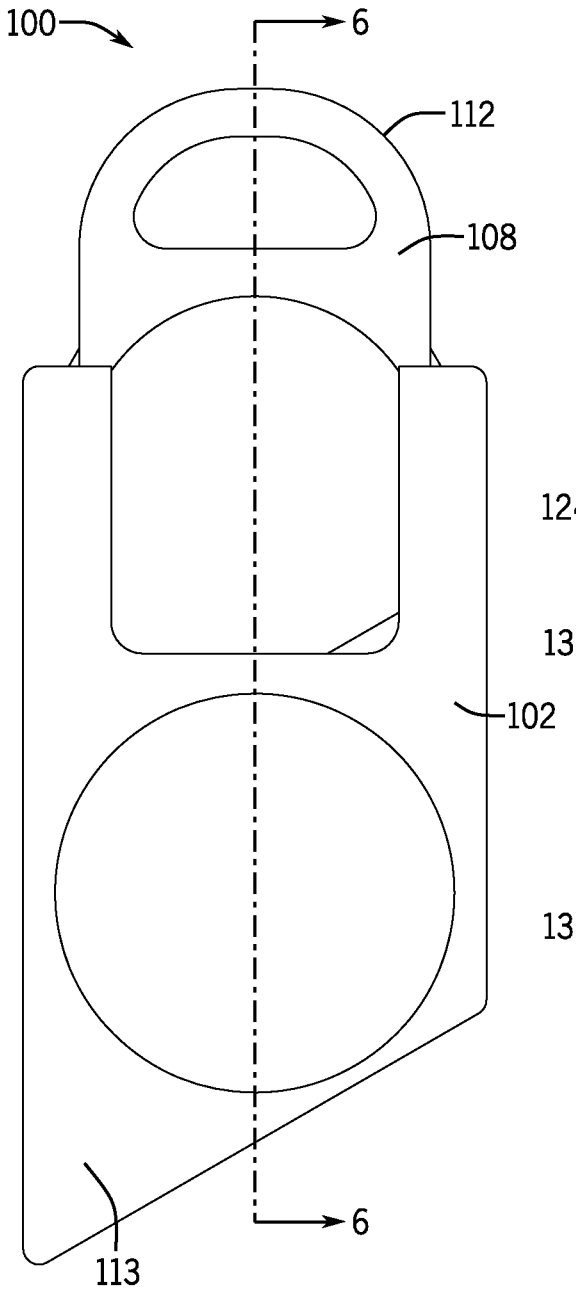
FIGS. 4A and 4B are respective rear and front views of the cigar cutter of FIGS. 3A and 3B in accordance with various embodiments of the present disclosure.
Figure 4B:
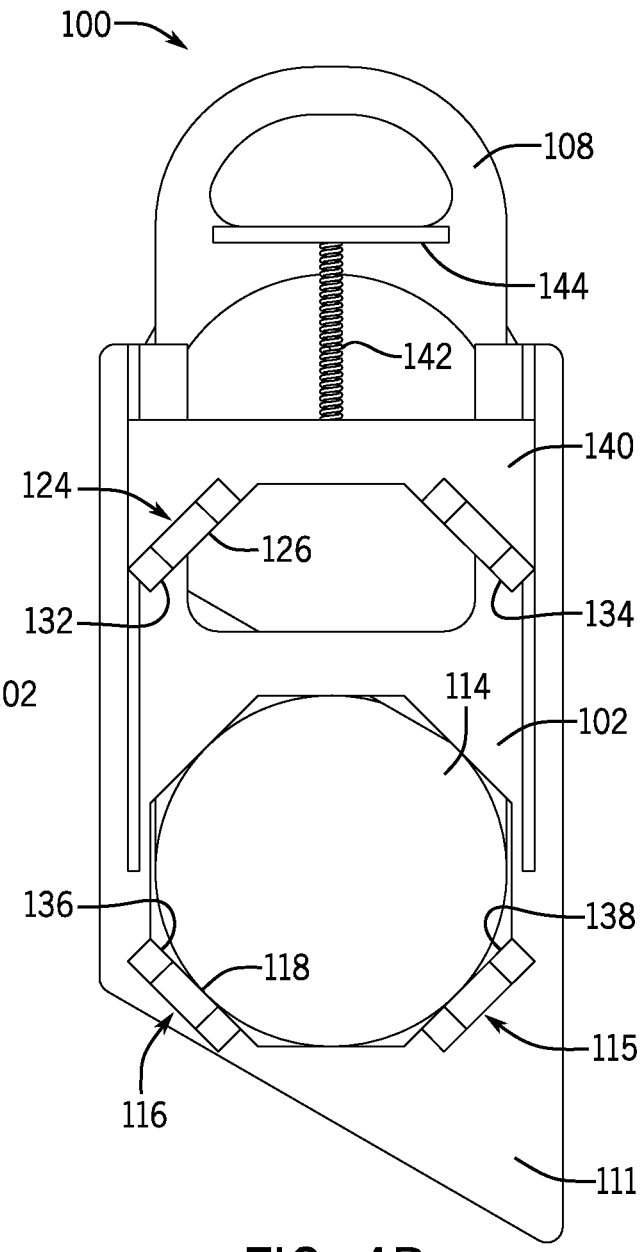
Figure 5B:
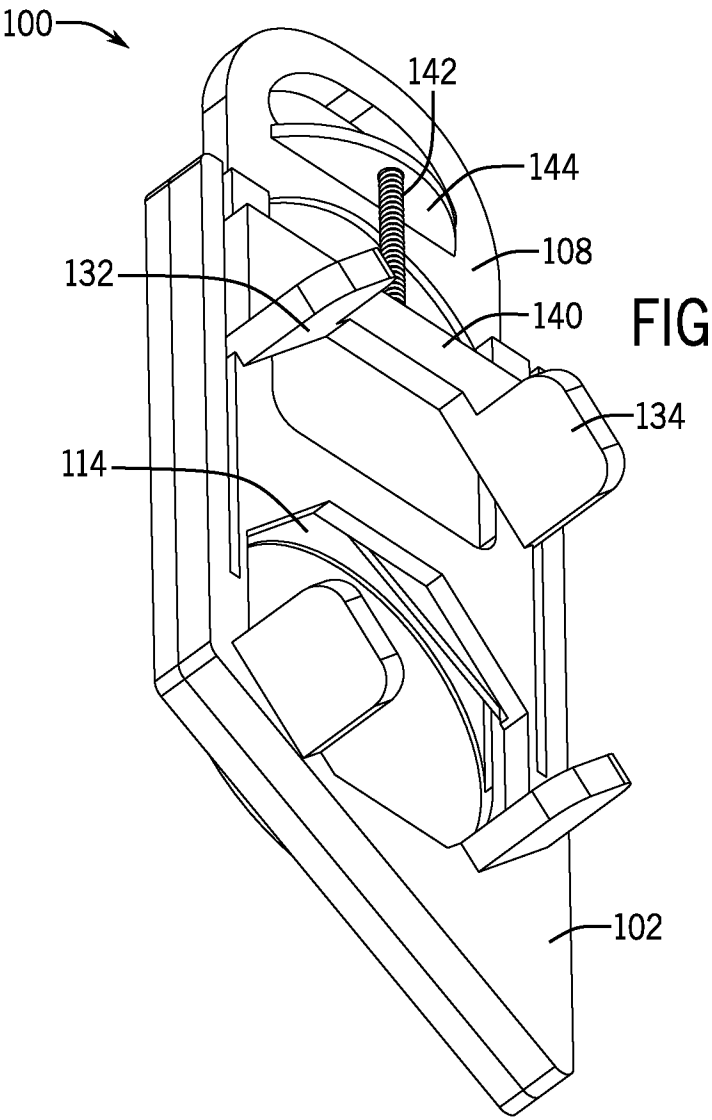
FIGS. 5A and 5B are respective top and bottom perspective isometric front views of the cigar cutter of FIGS. 3A and 3B in accordance with various embodiments of the present disclosure.
Figure 5A:
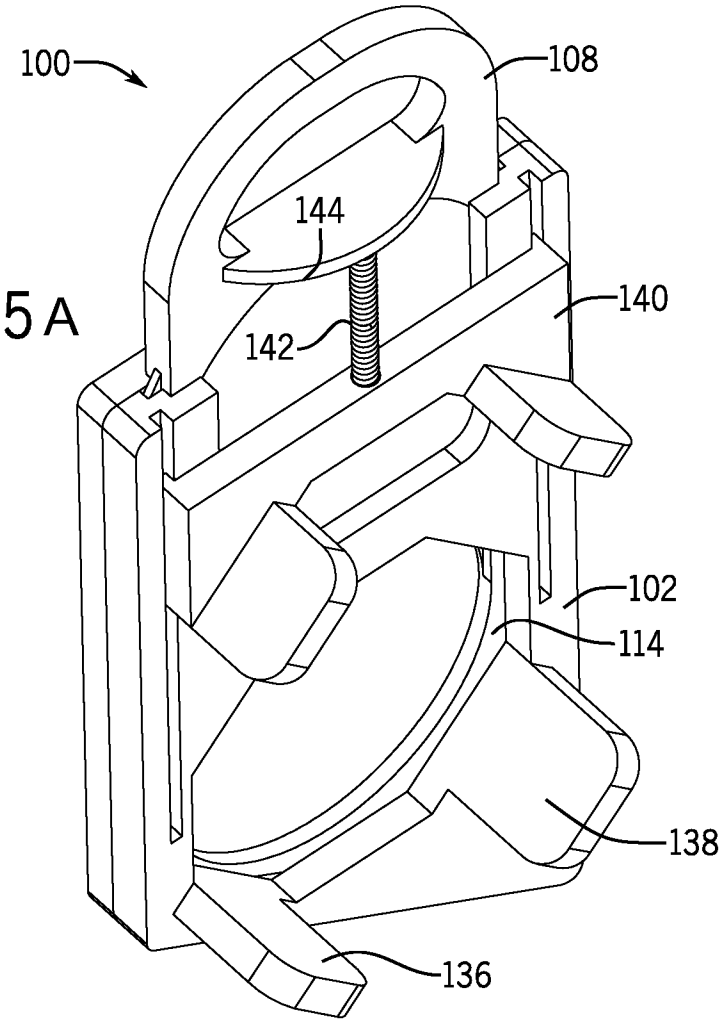

Referring to FIGS. 3A and 3B, the cigar cutter 100 includes a body 102 and a cutter portion 108, such that the cutter portion 108 is designed and configured to move relative to the body 102. The cutter portion 108 may include a cutting blade 110 and a cutter handle 112 coupled to the cutter blade 110. As a non-limiting example, the cutter portion 108 may be designed and configured to slide relative to the body 102.

In the illustrated embodiment, the body 102 includes a first body portion 104 and a second body portion 106 coupled together. As seen in the illustrated embodiment of FIG. 6, the first body portion 104 and the second body portion 106, when joined, can form a slot 107 therebetween. The slot 107 can be formed by the space between the first body portion 104 and the second body portion 106. The slot 107 may be sufficiently wide to allow the cutting blade 110 to fit therein. In some examples, the slot 107 defines a track along which the cutting blade 110 may move in response to any movement of the cutter portion 108. In that regard, or otherwise, the slot 107 may guide the cutting blade 110 relative to the body 102 while the cutter portion 108 is being moved towards the opening 114 of the body 102. Likewise, the first and second body portions 104 and 106 provide a housing for the cutting blade 110 to protect the user from accidentally cutting themself.

Figure 9A:
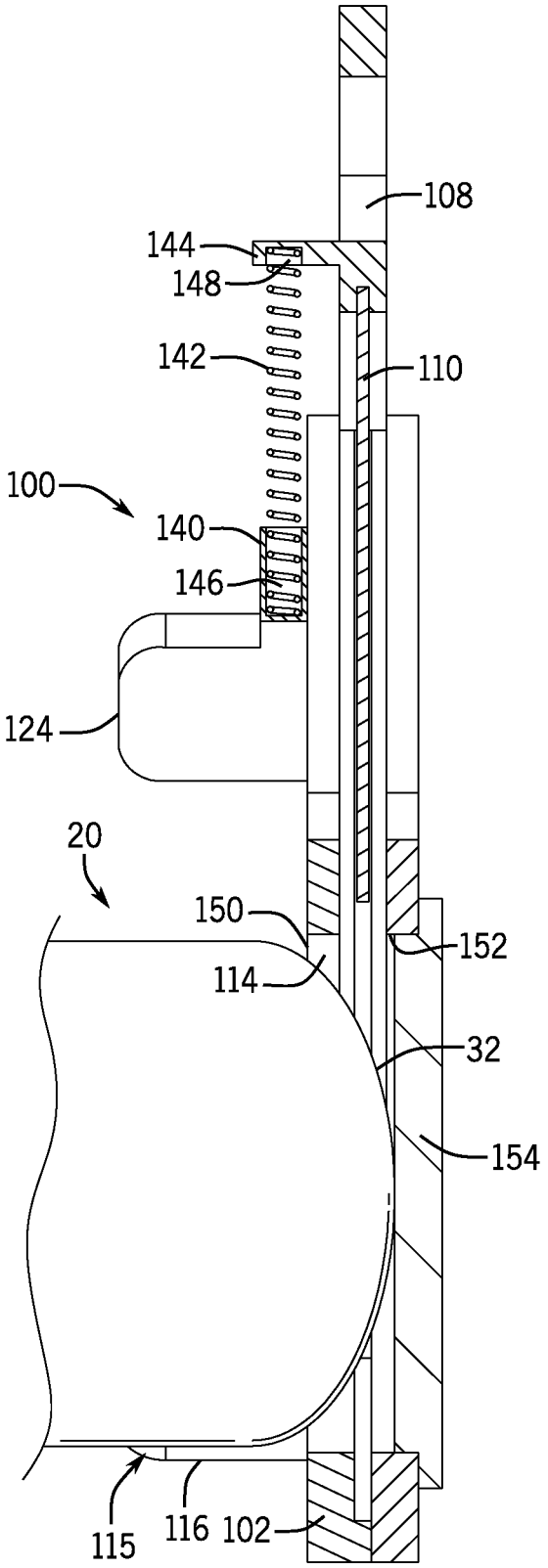
FIGS. 9A and 9B are a series cross-sectional views of the cigar cutter of FIGS. 3A and 3B with a cigar positioned within an opening of the cigar cutter prior to and after cutting the cigar in accordance with various embodiments of the present disclosure.
Figure 9B:
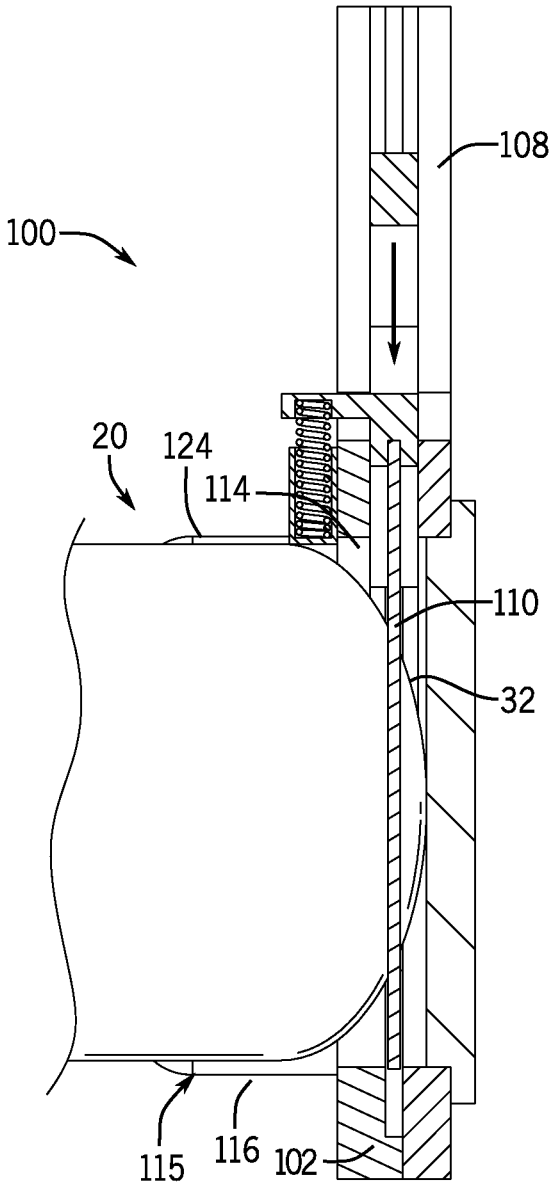

Referring to FIGS. 9A and 9B, during use, the cutter portion 108 is configured to be moved by the user using the handle 112 between a first cutting position (see FIG. 9A) and a second cutting position (see FIG. 9B) within the slot 107 defined between the first and second body portions 104 and 106 to effect a cutting action. If a cigar 20 is disposed within the opening 114, the cap 32 will be cut (compare FIGS. 9A and 9B).

The first body portion 104 and the second body portion 106 may be formed using any known materials such as a plastic, another polymer, metal, rubber, or any other material or combination of materials. The first body portion 104 may be coupled to the second body portion 106 in any known manner such as via use of fasteners, adhesive, bonding, welding, snap-fit connectors, interference fit, combinations thereof, or any other means. In some embodiments, the first body portion 104 may be formed integrally, with the second body portion 106. In that regard, the first body portion 104 may be removably coupled to the second body portion 106 or may be permanently coupled to the second body portion 106.

Likewise, the cutter handle 112 may be formed using any known materials such as a plastic, another polymer, metal, rubber, or the like. The cutter blade 110 may be formed using a metal or other material that is capable of being formed into a blade having a sharp edge. In that regard, an end of the cutter blade 110 designed to cut a cigar may be formed to have a sharp edge or blade. The cutter blade 110 may be coupled to the cutter handle 112 using any known means such as adhesive, fasteners, interference fit, snap connectors, or any other means.

Figure 7A:
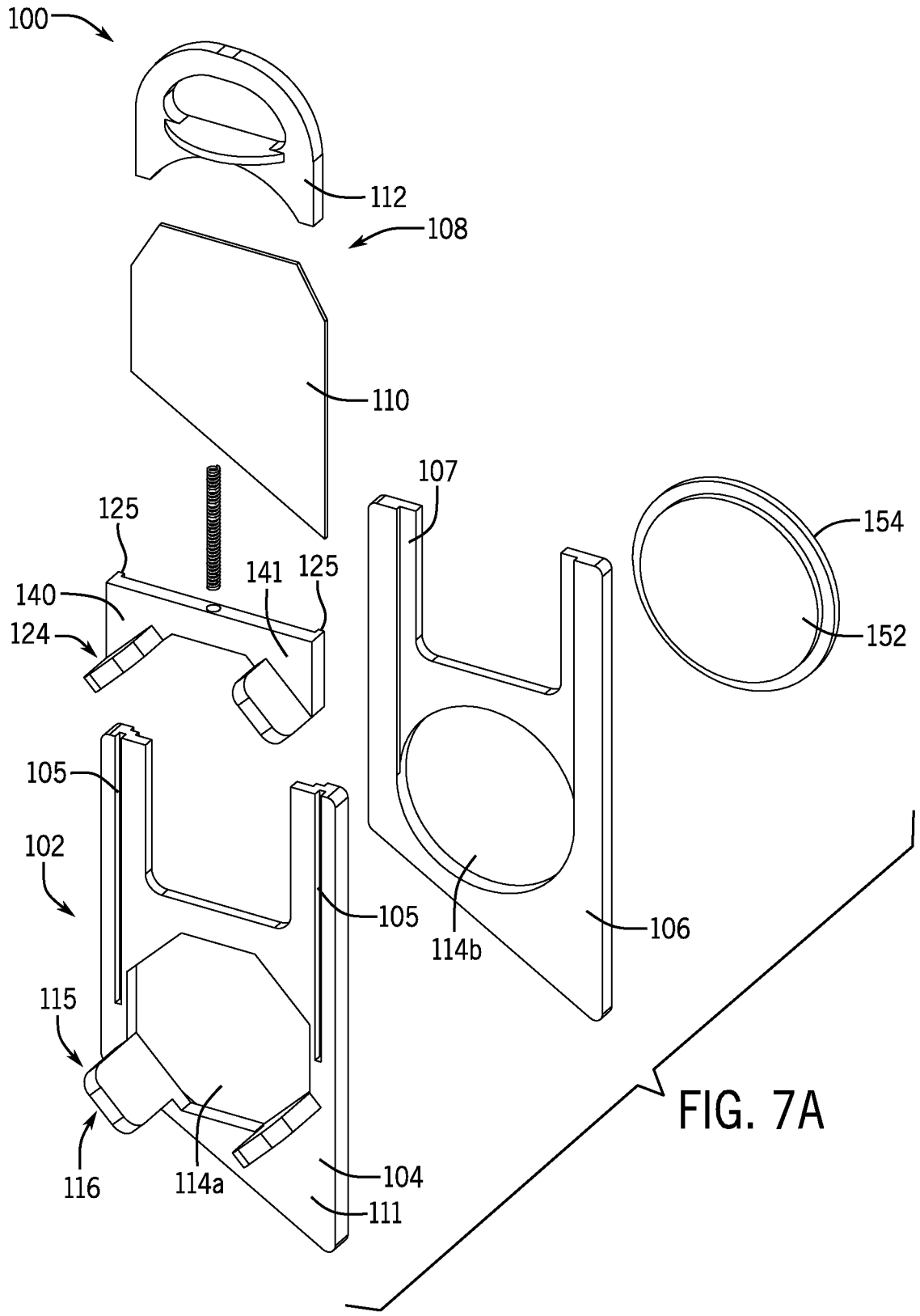
FIGS. 7A and 7B are respective front and rear isometric exploded views of the cigar cutter of FIGS. 3A and 3B in accordance with various embodiments of the present disclosure.
Figure 7B:
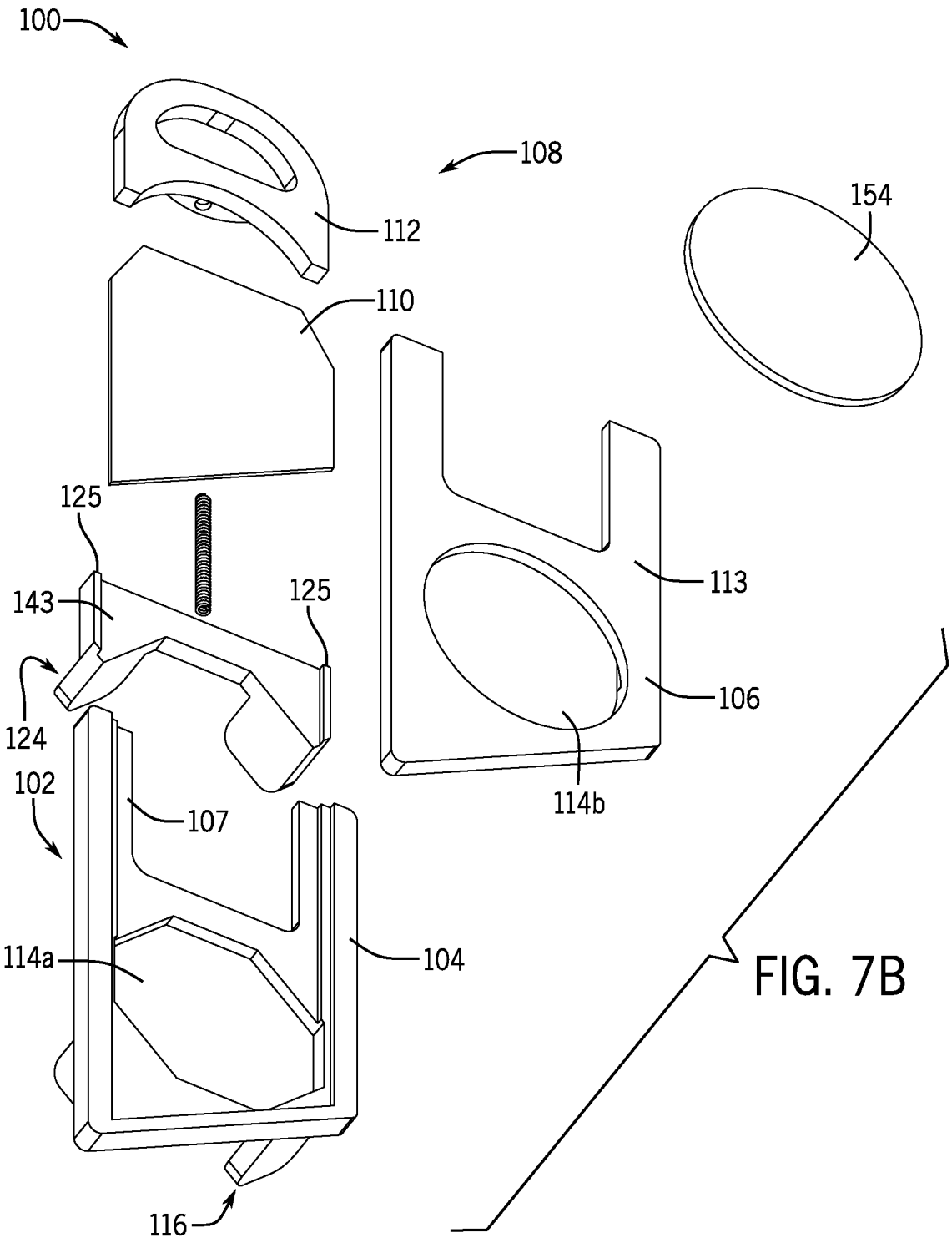
Figure 8A:
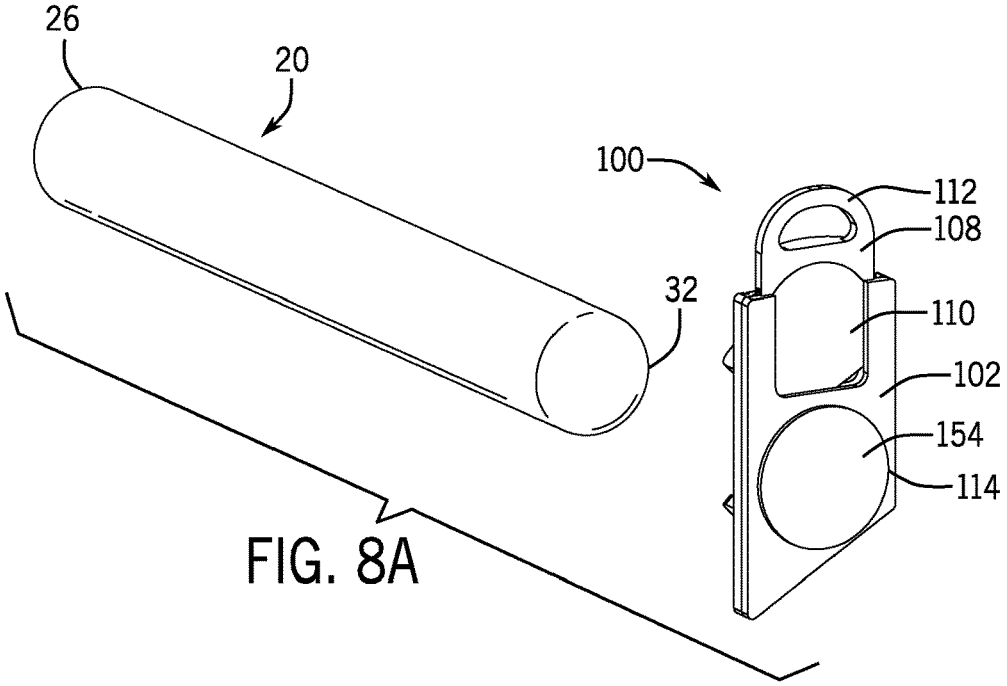
FIGS. 8A, 8B, 8C are a series of rear isometric views illustrating operation of the cigar cutter of FIGS. 3A and 3B when cutting a cigar in accordance with various embodiments of the present disclosure.
Figure 8B:
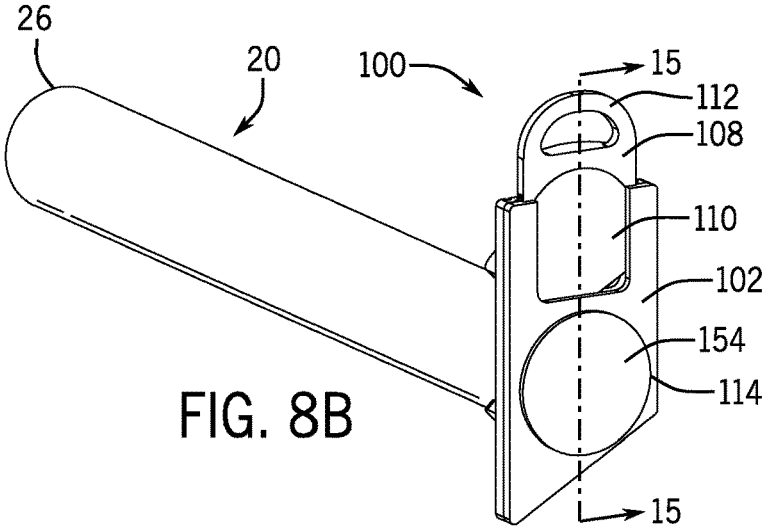
Figure 8C:
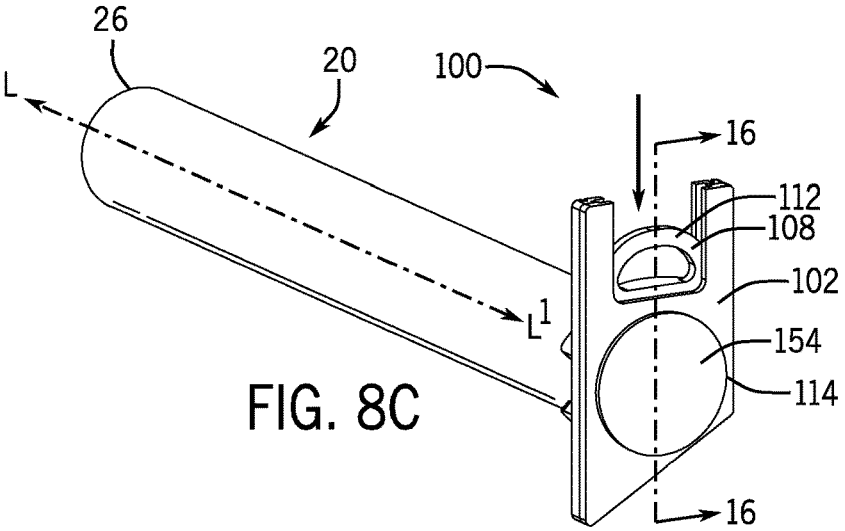

The body 102 includes an opening 114. In the illustrated embodiment, the opening 114 extends through the body 102 from the first side 111 of the body 102 to the second side 113 of the body 102. The opening 114 can be sized in a manner that allows for the opening 114 to receive a portion of a cap 32 or shoulder 30 of a cigar 20 (see, e.g., FIGS. 9A and 9B). As seen in FIGS. 7A and 7B, the body 102 may include a first opening 114*a* formed in the first body portion 104 and a second opening 114*b* formed in the second body portion 106 to define the opening 114. In some of these examples, or otherwise, the first and second openings 114*a* and 114*b* formed in these portions can align when the first body portion 104 is coupled with the second body portion 106. In various examples, the opening 114 extends through only a portion of the body 102. For instance, the opening 114 can be formed in, and extend completely through, the first body portion 104 but may not be formed in, or extend completely through, the second body portion 106. See discussion below regarding stop 154.

The cigar 20 may be inserted in opening 114. With the cap 32 or shoulder 30 of the cigar 20 in the opening 114, the cutter portion 108 is moved by the user towards the opening 114. The cutter blade 110 then cuts through at least a portion of the cap 32 or shoulder 30 of the cigar 20 (see, e.g., FIG. 1). The cutter blade 110 can be designed to be relatively sharp to affect a cut and reduce the likelihood of tearing or otherwise damaging a portion of the cigar wrapper that remains on the cigar 20 after the cut has been made.

A problem exists with conventional cigar cutters of all types in that handheld cigar cutters do not allow a user to ensure a cut that is precisely perpendicular to the end, or cap, of a cigar. Furthermore, the cut may vary between different cigars even though the cigar type and the cutter are the same. An angled cut (see, e.g., FIG. 1C) can affect the consistency and quality of experience of a cigar smoker. An angled cut can ruin the smoking experience by changing taste and feel of the cigar during smoking. For example, an angled cut cigar has a tendency to become more pronounced during smoking. The greater the angle of the cut, the harder it is for the cigar to stay lit. If the cigar does not stay lit, re-lighting may cause a charring of the tobacco in the cigar, making it even more difficult to re-light, and affecting the cigar smoking experience. In addition, the flavor of the cigar is very important. The flavor of the cigar can change drastically after relighting, which can also detract from the cigar smoking experience. The cigar cutter 100 disclosed herein provides solutions that remedy this problem.

Another problem experienced using conventional cigar cutters is the lack a mechanism to ensure that the cut of the cigar occurs at a constant and known location relative to the cigar. That is, using a conventional cigar cutter, if multiple cigars of the same type and size are cut, the location of the cut on the cigar will vary. This results in a variance in hole diameter of the hole in the cigar. This variance in hole diameter is a leading factor in an inconsistent experience for a user, even between the same type and size of cigar, which can undesirably reduce consistency and quality of a cigar smoking experience. The cigar cutter 100 of the present disclosure includes features that facilitate a constant cut location for all cigars.

The cigar cutter 100 in the illustrated embodiment of FIGS. 3A-9B includes a cradle 115 (see, e.g., FIGS. 3B and 4B) to facilitate alignment of a cigar relative to the cutting blade 110 prior to any cut being made to the cigar. In the illustrated embodiment, the cradle 115 includes a first and second cradle portions 116 and 124 extending from the first side 111 of the body 102 near opening 114. The first cradle portion 116 may be a fixed cradle portion relative to opening 114, and the second cradle portion 124 may be an adjustable cradle portion relative to opening 114, so as to accommodate cigars of different cross-sectional dimension. In other embodiments, the second cradle portion 124 may be a fixed cradle portion, and the first cradle portion 116 may be an adjustable cradle portion. Likewise, in other embodiments, both cradle portions may be fixed or both cradle portions may be adjustable.

In accordance with embodiments of the present disclosure, the cradle 115 may include one or both of the first and second cradle portions 116 and 124 extending from the first side 111 of the body 102 near opening 114. As illustrated in FIGS. 3B and 7A, the first cradle portion 116 can include one or more cigar support surfaces 118 extending outwardly relative to the first side 111 of the body 102. The one or more surfaces 118 may be oriented substantially perpendicularly to the cutting plane of the cutting blade 110 and/or to the plane defined by the opening 114. The one or more surfaces 118 may also be oriented substantially parallel to the longitudinal axis of the cigar to be cut.

In the illustrated embodiment, the one or more cigar support surfaces 118 are defined by protrusions extending from the body 102, for example, a first protrusion 120 that is positioned adjacent the opening 114 and a second protrusion 122 that is also positioned adjacent the opening 114. The first protrusion 120 can include a surface 136 that is oriented substantially perpendicularly to the cutting plane of the cutting blade 110 and/or to the plane defined by the opening 114. Similarly, the second protrusion 122 can also include a surface 138 that is substantially perpendicularly to the cutting plane of the cutting blade 110 and/or to the plane defined by the opening 114.

In some examples, the surfaces 136 and 138 are at an angle relative to each other such that surface 136 is not parallel to surface 138. In various examples, the surfaces 136 and 138 can be substantially tangential to the opening 114. In some embodiments, the one or more cigar support surfaces 118 of the first cradle portion 116 may form a V-shape. That is, if a first line is drawn parallel to a plane of the first surface 136, and a second line is drawn parallel to a plane of the second surface 138, the resulting lines would form a "V" shape that surrounds at least a portion of the opening 114. In some examples, the one or more surfaces 136 and 138 may be planar. In other examples, the one or more surfaces 136, 138 may be curved, for example, for "C" or "U" shaped surfaces. In other examples, the one or more surfaces extend around at least a portion of the opening 114 adjacent the opening 114 to support a cigar that is received within the opening 114.

The first cradle portion 116 may be formed from the same material used to form the body 102 or a different material. In that regard, the first cradle portion 116 may be formed integrally with the body 102 (e.g., the first body portion 104) or may be formed separately to the body 102.

In the illustrated embodiment, the second cradle portion 124 is coupled to support 140 having a first side 141 and a second side 143. Support 140 is movable relative to body 102 for positioning the second cradle portion 124 relative to opening 114 and a cigar 20 disposed therein. As illustrated in FIGS. 3B and 7A, the second cradle portion 124 (like the first cradle portion 116) can include one or more cigar support surfaces 126 extending outwardly relative to the first side 141 of the support 140. The one or more support surfaces 126 may be oriented substantially perpendicularly to the cutting plane of the cutting blade 110 and/or to the plane defined by the opening 114. The one or more surfaces 126 may also be oriented substantially parallel to the longitudinal axis of the cigar 20 to be cut.

As mentioned above, the second cradle portion 124 may be adjustable relative to the opening 114 between a first position (see FIG. 9A) and a second position (see FIG. 9B). In the illustrated embodiment, the second cradle portion 124 is slidably coupled to the body 102. For example, as illustrated in FIGS. 3B and 7A, the first side 111 of body portion 102 includes two groves 105 formed along a length of the first side 111. Flanges 125 extending from the second side 143 of the support 140 can be received within the groves 105 (see FIGS. 7A and 7B), which allows the second cradle portion 124 to move up and down along the length of the groves 105. Other slidable, movable, or pivoting configurations are also within the scope of the present disclosure.

As illustrated in FIGS. 3B and 7A, the second cradle portion 124 can include one or more cigar support surfaces 126 extending outwardly relative to the first side 141 of the support 140. The one or more surfaces 126 may be oriented substantially perpendicularly to the cutting plane of the cutting blade 110 and/or to the plane defined by the opening 114. The one or more surfaces 126 may also be oriented substantially parallel to the longitudinal axis of the cigar to be cut.

In the illustrated embodiment, the one or more cigar support surfaces 126 are defined by protrusions extending from the support 140, for example, a first protrusion 128 that can be positioned adjacent a shoulder of a cigar or opening 114 and a second protrusion 130 that can also be positioned adjacent a shoulder of a cigar or opening 114. The first protrusion 128 can include a surface 132 that is oriented substantially perpendicularly to the cutting plane of the cutting blade 110 and/or to the plane defined by the opening 114. Similarly, the second protrusion 130 can also include a surface 134 that is substantially perpendicularly to the cutting plane of the cutting blade 110 and/or to the plane defined by the opening 114.

In some examples, the surfaces 132 and 134 are at an angle relative to each other such that surface 132 is not parallel to surface 134. In various examples, the surfaces 132 and 134 can be substantially tangential to the opening 114. In some embodiments, the one or more cigar support surfaces 126 of the second cradle portion 124 may form a V-shape. That is, if a first line is drawn parallel to a plane of the first surface 132, and a second line is drawn parallel to a plane of the second surface 134, the resulting lines would form a "V" shape that surrounds at least a portion of the opening 114. In some examples, the one or more surfaces 132 and 134 may be planar. In other examples, the one or more surfaces 132, 134 may be curved, for example, for "C" or "U" shaped surfaces. In other examples, the one or more surfaces extend around at least a portion of the opening 114 adjacent the opening 114 to support a cigar that is received within the opening 114.

The second cradle portion 124 may be formed from the same material used to form the support 140 or a different material.

It should be appreciated by those skilled in the art that the second cradle portion 124 can be moveably coupled with the cutter portion 108 so that movement of the cutter portion 108 will cause a corresponding movement in the second cradle portion 124. For example, in some embodiments, when the cutter portion 108 moves towards the opening 114, the second cradle portion 124 will also move towards the opening 114 to surround and provide stability to the cigar being cut.

In the illustrated embodiment (see FIGS. 9A and 9B), the cigar cutter 100 of the present disclosure may include a biasing member 142 to bias the second cradle portion 124 to the first position.

To reduce the likelihood of the second cradle portion 124 damaging the cigar, the second cradle portion 124 can be configured to be limited in downward movement after contacting the cigar. For example, a biasing member 142 (shown as a spring) can be coupled between the second cradle portion 124 and lip portion 144 of cutter portion 108 extending from cutter handle 112. When the second cradle portion 124 is moved from the first position (see FIG. 9A) to the second position (see FIG. 9B), the biasing member 142 can urge the second cradle portion 124 from the second position to the first position. As a result, the biasing member 142 can provide suspension to prevent damage to the cigar 20.

As shown in FIGS. 9A and 9B, the support 140 can couple to the cutter portion 108 via the biasing member 142 (shown as a spring). The support 140 may define a coupling 146 for receiving a first end of the biasing member 142, and the cutter portion 108 may include a lip 144 extending outward therefrom that defines a coupling 148 for receiving a second end of the biasing member 142. In that regard, the biasing member 142 may be retained in place between the support 140 and the lip 144 (and, thus, the remainder of the cutter portion 108).

Figure 6:
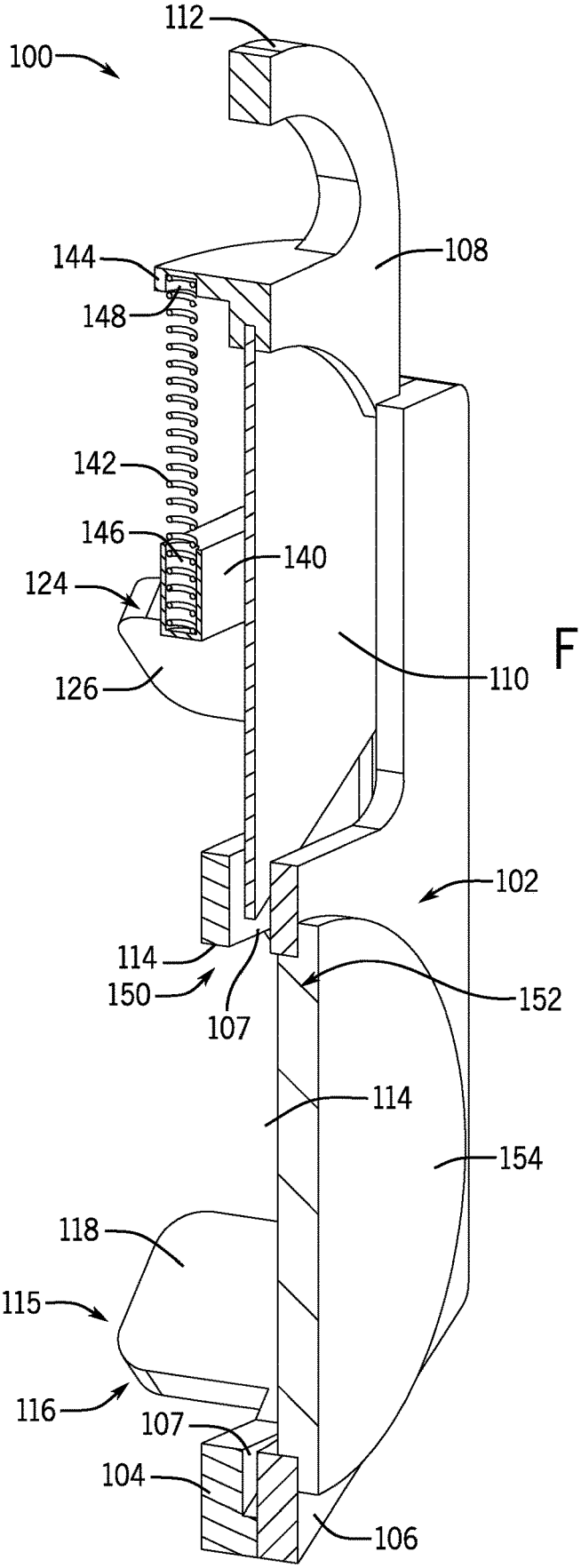
FIG. 6 is a cross-sectional rear isometric view of the cigar cutter of FIGS. 3A and 3B in accordance with various embodiments of the present disclosure.

In the illustrated embodiment of FIGS. 6, 9A, and 9B, the biasing member 142 is biased such that the second cradle portion 124 is biased toward the first position (see FIG. 9A). The user can apply pressure to the second cradle portion 124, for example, using the user's fingers to move the second cradle portion 124 to the second position (see FIG. 9B). When in the second position (see FIG. 9B), the second cradle portion 124 and the first cradle portion 116 can be positioned around the cigar 20 to maintain the cigar in a suitable cutting position before the cutting portion 108 is moved to cut the cigar 20.

When the cutting portion 108 is moved from its first position to its second position, by retaining the biasing member 142 in place between the support 140 and the lip 144, the second cradle portion 124 does not extend further downward after contacting the cigar. Instead, the biasing member 142 compresses upon itself as the cutter portion 108 moves further downward.

In various embodiments, the biasing member 142 can provide a compressive force through the second cradle portion 124 to secure the cigar 20 in a substantially perpendicular orientation to the cutting blade 110 during the cutting operation. For example, when the biasing member 142 is compressed, the biasing member 142 can exert an additional force on the cigar that can act to secure the cigar 20 in its orientation. In some embodiments, the biasing member 142 can bias the second cradle portion 124 in another direction, for example, from the first position to the second position.

Embodiments of the cigar cutter 100 of the present disclosure can include a stop 154 to assist with positioning a cigar at a consistent location within the cigar cutter 100. Referring specifically to FIGS. 6, 7A-7B, and 9A-9B, the stop 154 can be coupled to the body 102 at the opening 114. The stop 154 can have a body that is sized to be received within the opening 114. For example, as shown in FIGS. 9 and 10, the stop 154 can have circular shaped body with a stop end 152 that can be received within the opening 114. The stop 154 may include any feature having a diameter that is similar to, greater than, or less than the diameter of the opening 114. In some embodiments, when the stop 154 is coupled to the body 102, the body 102 and the stop 154 form a cigar receiving end 150 into which a cigar may be entered into the opening 114 (that is, a cigar may be moved from a location away from the cigar cutter 100 towards the cigar receiving end 150 of the opening 114). In some embodiments, the cigar receiving end 150 is formed by the first body portion 104. The stop 154 may be made from any material such as a plastic, other polymer, metal, rubber, or the like. The stop 154 may be coupled to the body 102 using any known means such as a press-fit or snap-fit connection, an interference fit, a fastener, a clip, hook and loop fasteners, other fasteners, adhesive, bonding, welding, or any other means. In various embodiments, the stop 154 is integrally formed with the body 102 so that the stop 154 and body 102 function as a single part.

In some embodiments, the stop 154 and body 102 may be removably coupled. For example, the stop 154 may be designed to snap into a specific location on the body 102 (e.g., the stop 154 may snap into a portion of the opening 114 defined by the second body portion 106). In some examples, the stop 154 can be removed from the opening 114 (e.g., by disconnecting the stop 154 from the body 102). As will be discussed further below, the stop 154 facilitates a constant cut location for any cigar cut by the cigar cutter 100 by allowing the user to press cap of the cigar against the stop end 152. In that regard, different stops 154 may be provided (e.g., stops 154 of various sizes), with each stop 154 providing a different cut location on a cigar.

A user may select a stop 154 that results in a cut at a location desired by the specific user, couple the desired stop 154 to the body 102, and move the cutter portion 108 to cut the cigar at the desired location. If the user prefers a deeper cut on the cigar (i.e., closer to the body) then the user may select a new stop 154 that sits further from the body 102 (e.g., the stop end 152 is longer in length) and, if the user prefers a shallower cut on the cigar (i.e., closer to the cigar cap) then the user may select a new stop that sits closer to the body 102 (e.g., the stop end 152 is shorter in length). Likewise, the stop 154 may be adjustable for variable depth in cut depending on user preference.

Referring specifically to FIGS. 9A and 9B, an exemplary operation of the stop 154 is shown. In FIG. 9A, the desired stop 154 that corresponds to a desired cut location on a cigar is coupled to the body 102 of the cigar cutter 100. In particular, the stop 154 may be coupled to the second body portion 106 of the body 102 (see, e.g., FIG. 9). In FIG. 9A, after moving the cigar 20 towards the body 102, the cap 32 of the cigar 20 extends through the cigar receiving end 150 of the opening 114, and the cap 32 contacts the stop end 152. The stop 154 resists further insertion of the cigar 20 into the opening 114 such that any cut achieved by the cutting blade 110 will be at a known and desired location along a length of the cigar 20 (see FIG. 9B). In that regard, the stop 154 facilitates a constant and known cut location on any cigar.

Figure 14:
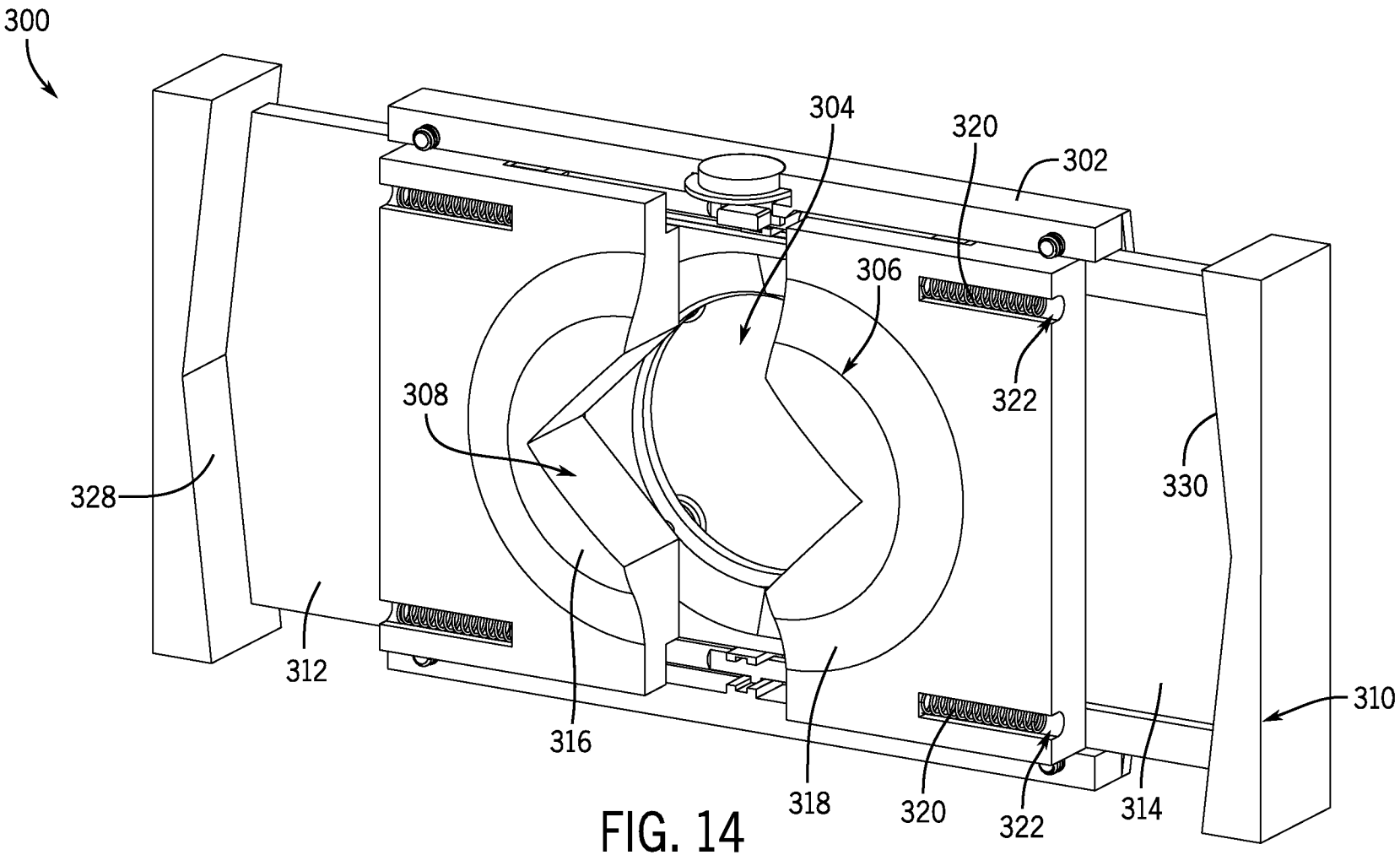
FIG. 14 is a perspective view of the cigar cutting device of FIG. 12 with some components hidden for clarity.

While in the orientation shown in FIGS. 9A and 9B, the cap, shoulder, or head of the cigar 20 may be in contact with the first cradle portion 116 of the body 102. The first cradle portion 116 may facilitate at least partial alignment of the cigar 20 within the opening 114. The cutter portion 108 may be moved downward (e.g., towards the opening 114). Likewise, the second cradle portion 124 may contact the cap, shoulder, or head of the cigar 20. When the second cradle portion 124 is in contact with the cigar 20 and the first cradle portion 116 is also in contact with the cigar 20, the cigar 20 can be aligned in a desirable orientation (e.g., a longitudinal axis of the cigar 20 may be oriented substantially perpendicular to the plane defined by the opening 114 or the stop 154). In that regard, any cut made by the cutting blade 110 may be a cut substantially perpendicular to the longitudinal axis of the cigar, cut along the cap, head, or shoulder of the cigar 20. When the cutter portion 108 is further moved downwards (after the second cradle portion 124 is in contact with the cigar 20) as shown in FIG. 14, the biasing member 142 (see, e.g., FIG. 9B) may compress such that the second cradle portion 124 fails to damage the cigar 20 (e.g., by being prevented from moving further downward with the cutter portion 108). During this additional downward movement, the cutting blade 110 may cut through a portion of the cap, shoulder, or head of the cigar 20. While the cut is being made, the first cradle portion 116 and the second cradle portion 124 cause the cigar 20 to remain aligned with the opening 114 throughout the cutting process to ensure a straight cut (as opposed to an angled cut) is achieved on the cigar 20. Similarly, the stop 154 causes the cap 32 of the cigar 20 to be inserted a desired and known distance through the opening 114, thus facilitating a cut at a desired location along the length of the cigar 20. Thus, the first and second cradle portions 116 and 124 and stop 154 together function to (1) ensure that the cutter blade 110 makes a desired (e.g., straight) cut on the cigar 20, and (2) ensure that the cutting blade 110 makes the cut at a known and desired location on the cigar 20.

Referring to FIGS. 8A-8C and 9A-9B, a method of using a cigar cutter 100 in accordance with embodiments of the present disclosure will now be described. A user may use the cigar cutter 100 to achieve an even cut on a cigar, the cap or shoulder of the cigar may be inserted into the opening 114. A portion of the shoulder or cap of the cigar may be aligned with and positioned adjacent the first cradle portion 116. The user can then move the cutter portion 108 towards the opening 114 until the second cradle portion 124 contacts a portion of the shoulder or cap of the cigar. After the second cradle portion 124 and the first cradle portion 116 together contact the cigar, the cigar can be realigned into a desired cutting position. For example, the second cradle portion 124 and the first cradle portion 116 together can align the cigar so that the longitudinal axis of the cigar is perpendicular to the plane defined by the opening 114. In some examples, the second cradle portion 124 and the first cradle portion 116 can realign the cigar into the desired cutting position because the second cradle portion 124 and the first cradle portion 116 can both contact the cigar at the same time. By contacting the cigar at the same time, the contacting force from both the cutting portion cradle 124 and the first cradle portion 116 moves the cigar so that the longitudinal axis of the cigar is substantially perpendicular to the plane of the opening 114. In some examples, the force applied by cutting portion cradle 124 is similar, or substantially the same amount of force, as the force applied by the first cradle portion 116. Additionally, or alternatively, both the cutting portion cradle 124 and the first cradle portion 116 apply the force at substantially the same axial location along the cigar. Aligning the cigar in any of these manners can facilitate a substantially straight cut along the cap or shoulder of the cigar. In various embodiments, the second cradle portion 124 and the first cradle portion 116 can align the cigar in a different manner (e.g., so that the longitudinal axis of the cigar is at an angle with the plane of the opening 114). Once the cigar is positioned in the desired orientation, the cutter portion 108 may then continue to move towards the opening 114 until the cutting blade 110 cuts through the desired portion of the cap or shoulder of the cigar.

Figure 10A:
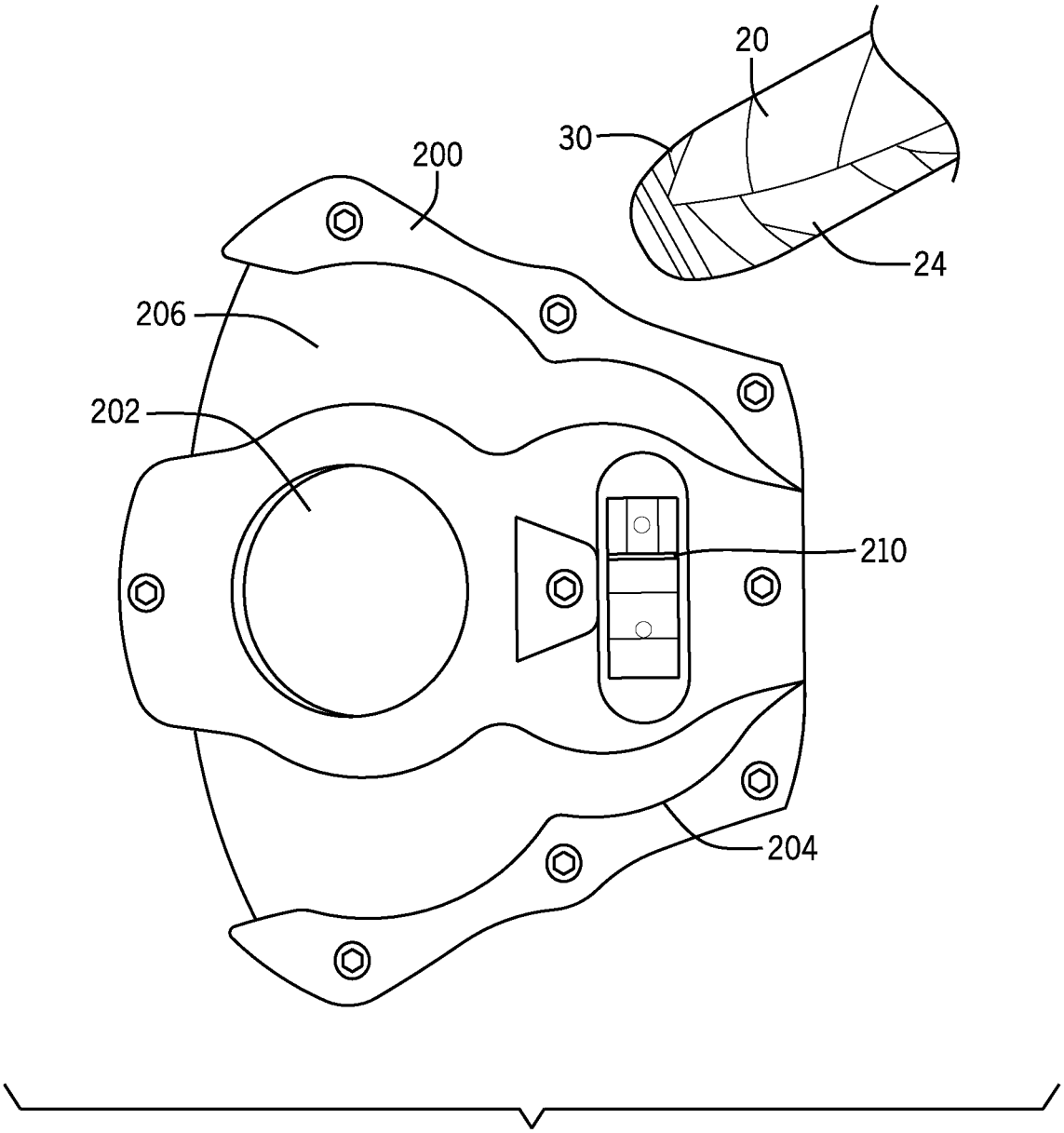
FIGS. 10A and 10B are a series of drawings showing a method of cutting a cigar using a cigar cutter having a level indicator in accordance with various embodiments of the present disclosure.
Figure 10B:
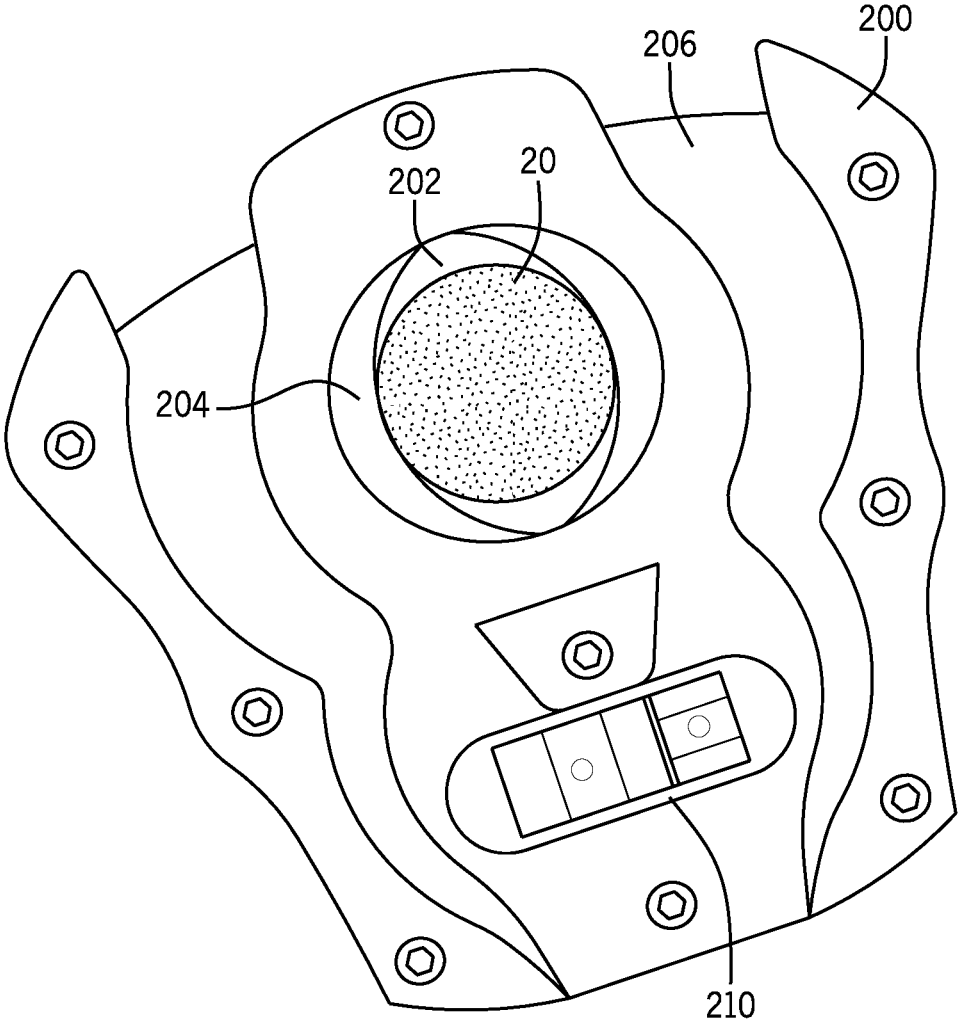
Figure 11A:
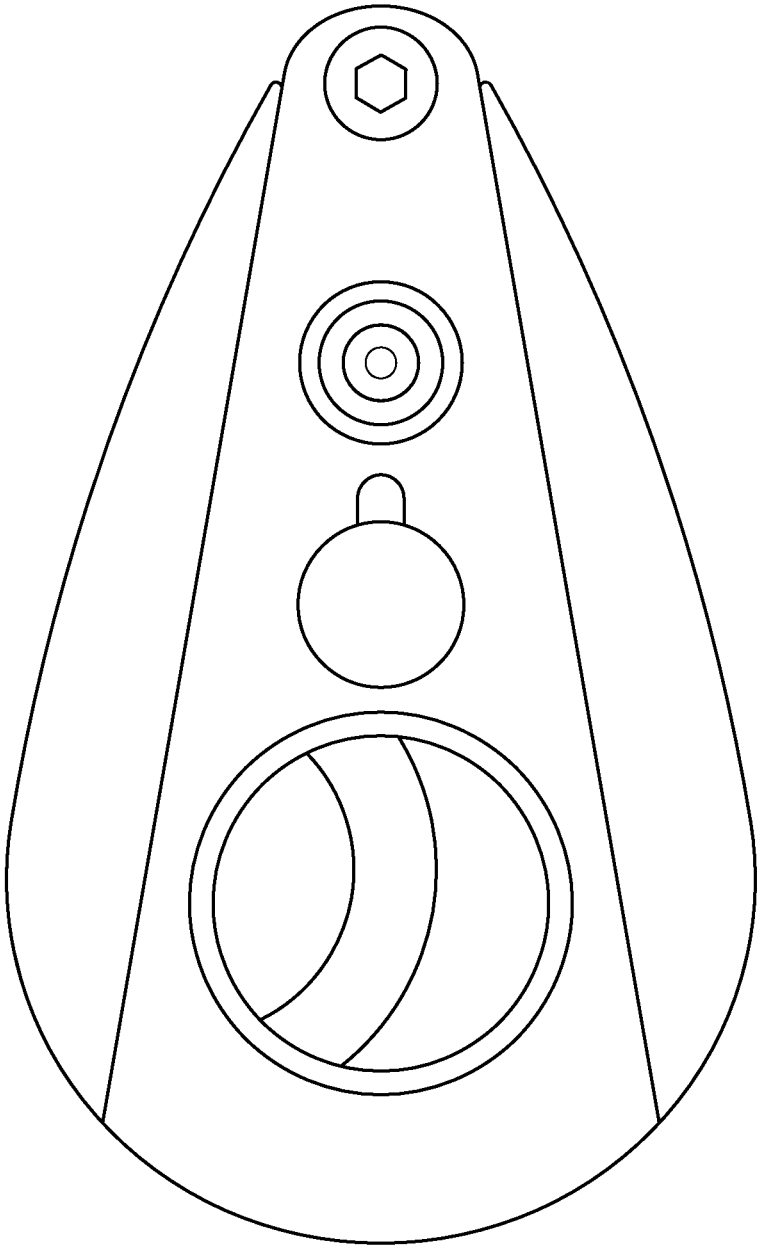
FIGS. 11A-11I are drawings illustrating examples of various different types of cigar cutters having various different level indicators attached thereto in accordance with various embodiments of the present disclosure.
Figure 11B:
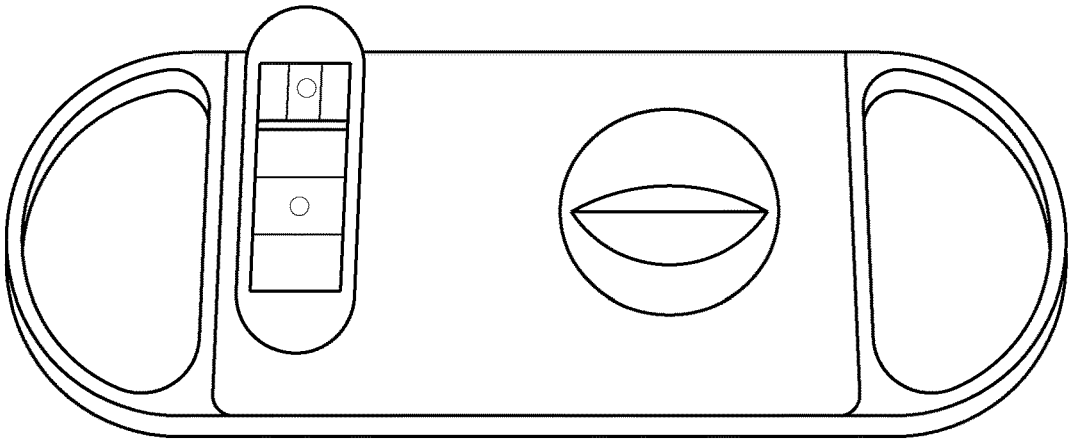
Figure 11C:
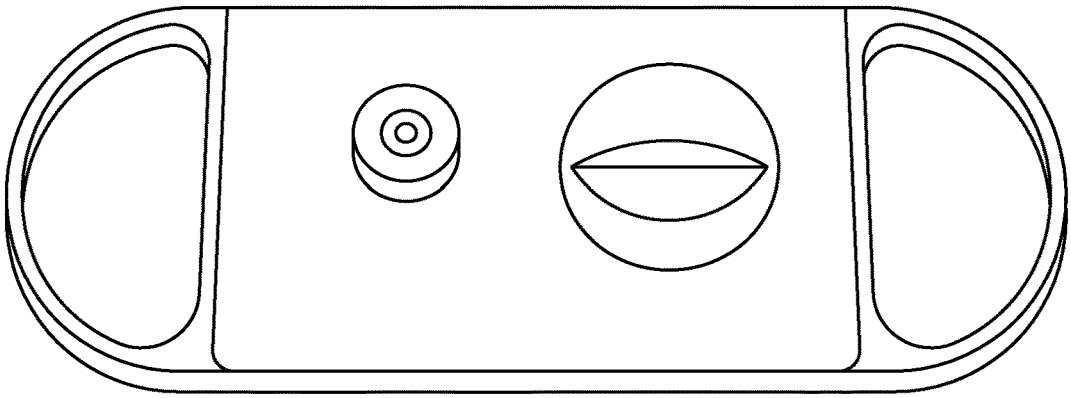
Figure 11D:
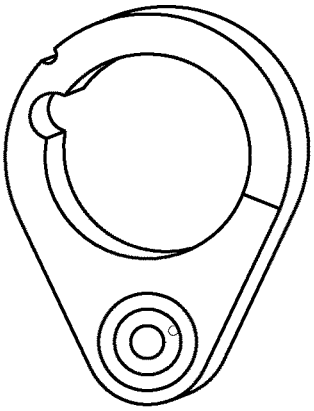
Figure 11E:
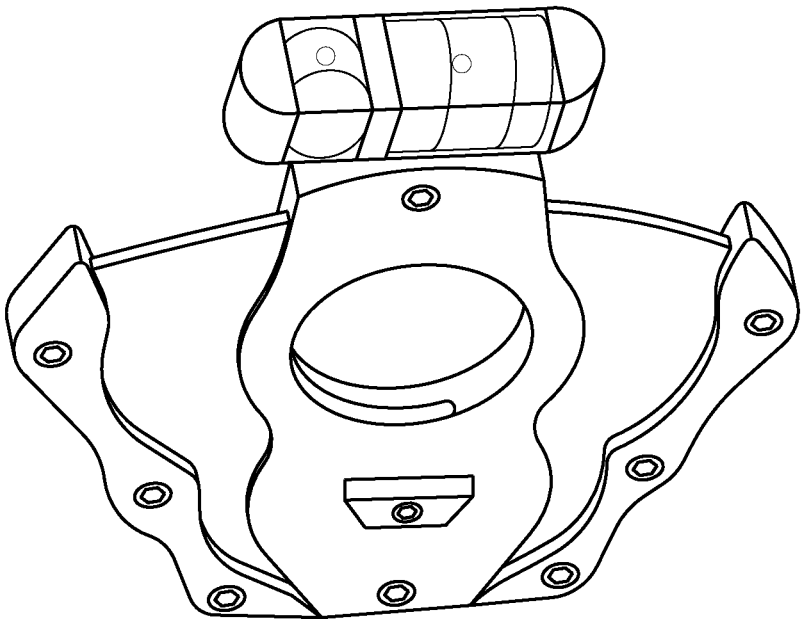
Figure 11F:
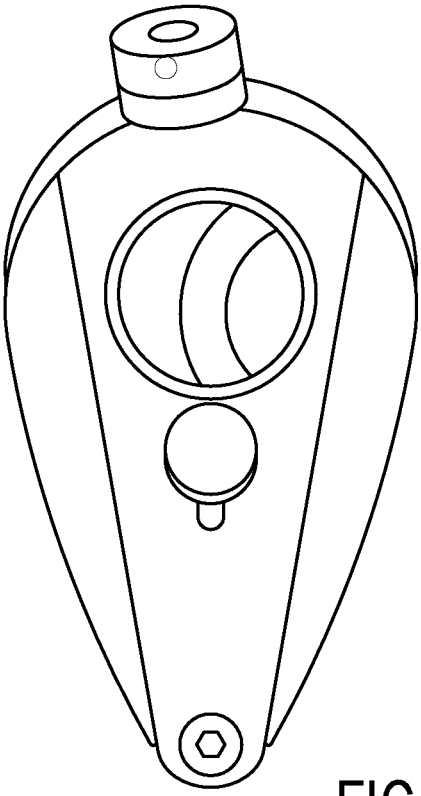
Figure 11G:
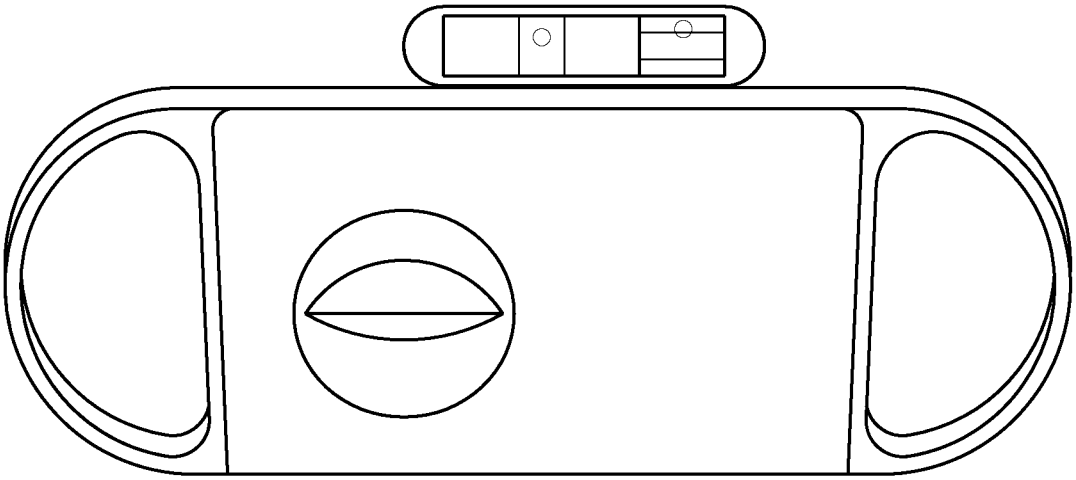
Figure 11H:
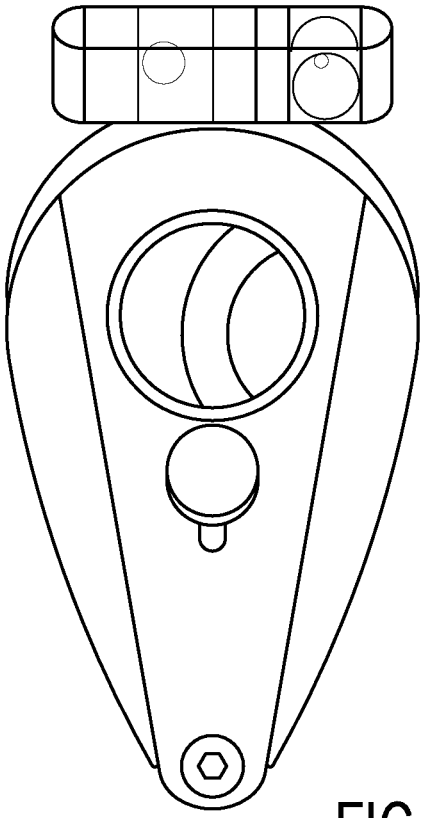
Figure 11I:
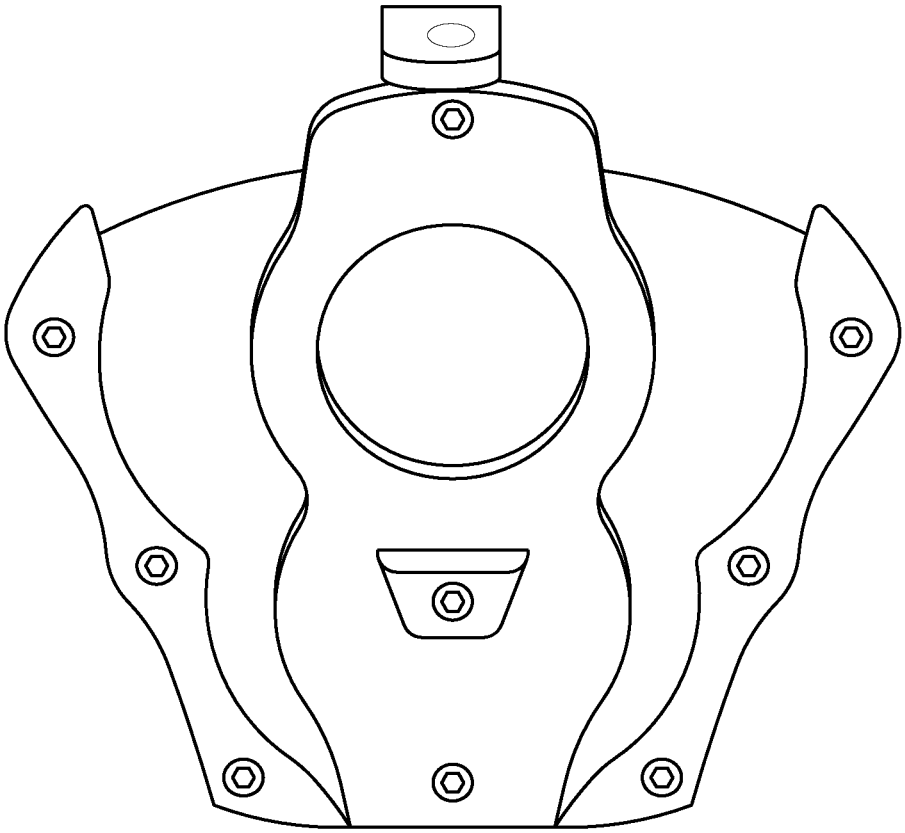

Cigar cutters in accordance with embodiments of the present disclosure may also include a level indicator for ensuring a level cut. Referring to FIGS. 10A and 10B, illustrations of an exemplary cigar cut using a cigar cutter 200 having a level indicator 210 are provided. When cutting a cigar using a straight cutter, the user identifies the shoulder 30 of the cigar 20, which is the transition point between the cap 32 and the head 24 of the body 22 of the cigar 20 (see FIG. 1).

Referring to FIG. 10B, the head of the cigar 20 is placed inside the opening 202 of the cutter 200 (shown as a double-bladed cutter), and slightly close the blades 204 and 206 so they are just touching the cigar 20 around its shoulder 30. Closing the blades 204 and 206 to a touching configuration maintains the cigar 20 in proper position and prevents motion that can lead to tearing or to cutting at the wrong location. When the cigar 20 is in place, a cut can be made using swift, even pressure.

Ideally, the cigar cutter achieves a cut that is in a substantially level plane that is substantially perpendicular to the longitudinal axis of the cigar. As discussed above, referring to FIG. 1B, a level cigar cut is illustrated. Referring to FIG. 1C, an angled cigar cut is illustrated.

Some embodiments of the present disclosure are directed to cigar cutters having leveling features for detecting a level orientation and achieving a planar cut perpendicular to the longitudinal axis of the cigar, as opposed to an angled cut.

Referring to FIGS. 10A and 10B, a method of cutting a cigar 20 using a cigar cutter 200 designed and configured in accordance with embodiments of the present disclosure includes placing a cigar body 22 on the end of a horizontal surface (not shown) with the head 24 of the cigar 20 extending off the horizontal surface. Laying the cigar 20 on a flat horizontal surface (such as a table end) can establish a level orientation for the cigar 20.

After a level orientation is establish for the cigar, the head 24 of the cigar 20 is placed inside an opening 202 of a cigar cutting device 200, wherein the cigar cutting device 200 has one or more blades 204 and 206 and a level indicator 210 attached to the cutting device 200 to indicate the orientation of the cutting device 200.

The one or more blades 204 and 206 of the cigar cutting device 200 can be placed to be exactly perpendicular to the horizontal surface as indicated by the level indicator 210 attached to the cutting device 200. When a perpendicular orientation is achieved, the one or more blades 204 and 206 of the cigar cutting device 200 can be slightly closed to be touching the cigar 20 around a shoulder 30 at the head 24 of the cigar 20.

After such orientation and touching is achieved, the one or more blades 204 and 206 are closed around the cigar shoulder 30 to achieve a level cut.

In an alternate method, the cigar orientation can be established vertically, for example, if the cigar is held in a vertical orientation or laid against a vertical surface, with the head of the cigar 20 extending off the vertical surface. Then, the one or more blades 204 and 206 of the cigar cutting device 200 can be placed to be exactly perpendicular to the vertical surface as indicated by the level indicator 210 attached to the cutting device 200.

Referring to FIGS. 11A-11I, various types of cigar cutting devices having level indicators attached in various orientations in accordance with embodiments of the present disclosure are illustrated. A level indicator may be added to any type of cigar cutter to be contemplated within the scope of the present disclosure.

FIGS. 12-17 illustrate various aspects of a cigar cutter 300. Similar to the previously described cigar cutter 100, the cigar cutter 300 can be configured to cut a cigar 20 in a manner that creates a smooth, level opening within the cigar 20 without compromising the integrity of the cigar 20.

Figure 12:
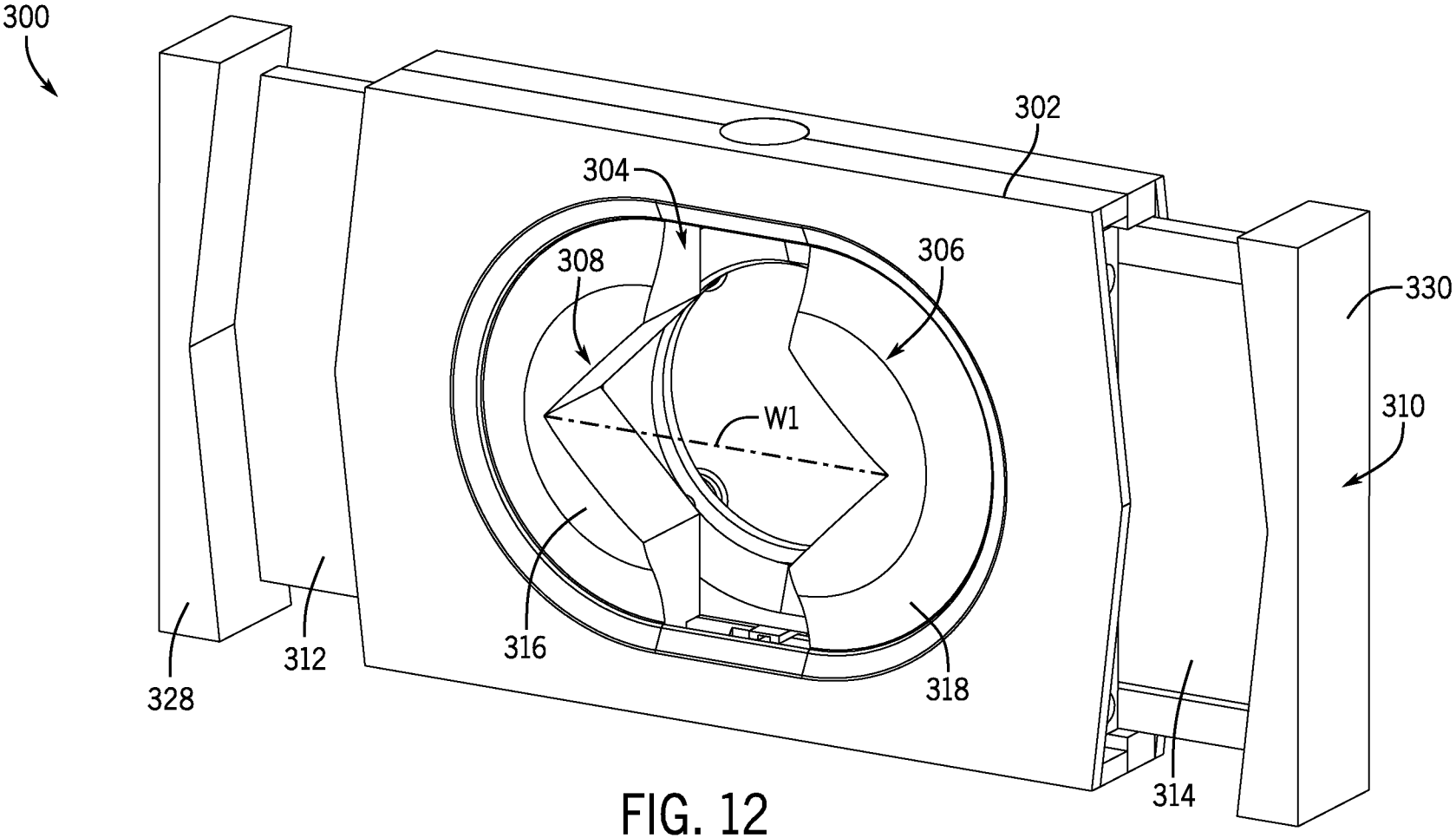
FIG. 12 is a perspective view of a cigar cutting device in accordance with various embodiments of the present disclosure.

As shown in FIG. 12, the cigar cutter 300 includes a body 302 which can define at least a portion of the housing for the cigar cutter 300 and can provide structural support to the cigar cutter 300 and its components. As illustrated in FIG. 12, the body 302 of the cigar cutter 300 can surround at least a portion of the components of the cigar cutter 300. The body 302 of the cigar cutter 300 can also define an opening 304 for receiving at least a portion of the cigar within. As shown in FIG. 12, the opening 304 can be formed in a slot-like shape so that the length of the opening 304 is larger than the width of the opening 304.

The cigar cutter 300 can also include a cradle 306 for facilitating proper alignment of the cigar 20 within the cigar cutter 300. As shown in FIG. 12, the cradle 306 can couple to the body 302 so that at least a portion of the cradle 306 is disposed within the opening 304 of the body 302. As will be described in more detail herein, the cradle 306 can define a receiving portion 308 which can be configured to grasp a portion of the cigar 20 and align the cigar 20 properly within the cigar cutter 300 (e.g., such that the barrel of the cigar 20 is perpendicular to the front face of the body 302). In some examples, the receiving portion 308 defines an opening of a desired shape.

In the illustrated embodiment, the cigar cutter 300 also includes a cutter portion 310 which can be configured to cut the cigar 20 in the desired manner. As shown in FIG. 12, the cutter portion 310 can include a first blade portion 312 and a second blade portion 314 which can couple to the body 302 so that the first and second blade portions 312, 314 extend off from opposing sides of the body 302. As will be described in more detail herein, the first and second blade portions 312, 314 of the cutter portion 310 can be adjusted by the user to cut the cigar 20 as desired.

Figure 13:
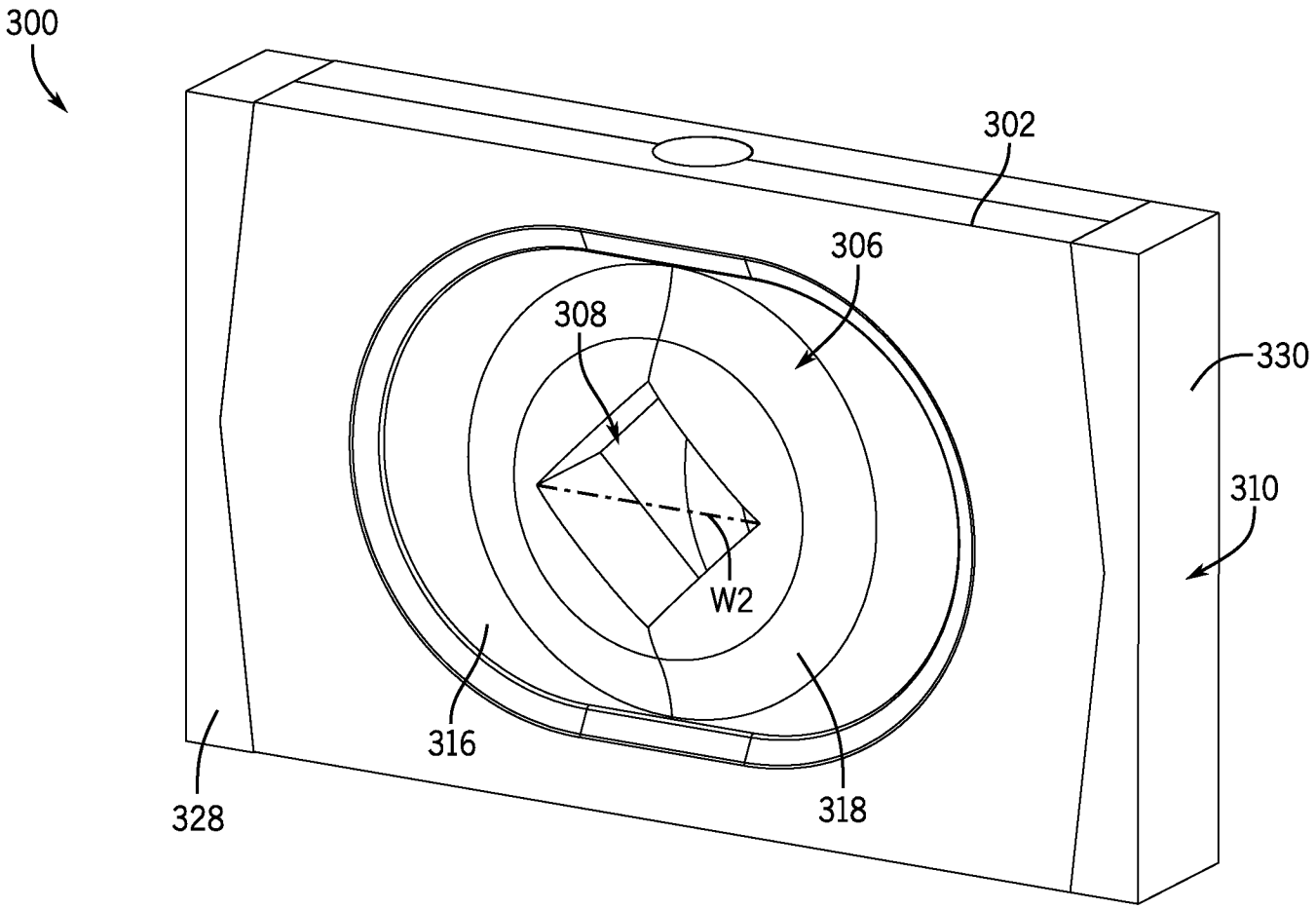
FIG. 13 is a perspective view of the cigar cutting device of FIG. 12 in a second position.

To perform a desirable cut, the cigar cutter 300 can be adjusted between at least two positions. For example, the cigar cutter 300 can be adjusted to a first position where the cigar cutter 300 is configured to receive a cigar 20 (as shown in FIG. 12), and a second position where the cigar cutter 300 can cut the cigar 20 (as shown in FIG. 13). When the cigar cutter 300 is in the first position illustrated in FIG. 12, both the cradle 306 and the cutter portion 310 can be positioned in a first, widened position. For instance, as shown in FIG. 12, the receiving portion 308 of the cradle 306 can be at a first width W1 while the first and second blade portions 312, 314 of the cutter portion 310 are positioned away from the body 302 and away from the opening 304. In this configuration, the opening 304 of the body 302 is exposed and at least partially unimpeded, which allows for a user to place a cigar 20 within. When the cigar cutter 20 is in the second position illustrated in FIG. 13, both the cradle 306 and the cutter portion 310 can be positioned in a second, narrowed position. For instance, as shown in FIG. 13, the receiving portion 308 of the cradle 306 can be at a second width W2, which is less than the width W1, and the first and second blade portions 312, 314 of the cutter portion 310 can be nested against the sides of the body 302. In this configuration, the receiving portion 308 of the cradle 306 can be narrowed, which allows for the cradle 306 to grasp and align the cigar 20. Furthermore, the first and second blade portions 312, 314 of the cutter portion 310 can extend laterally beyond the opening 304 and intersect one another, which can thereby cause the first and second blade portions 312, 314 to cut a cigar 20 positioned within the opening 304.

Additional details of the cradle 306 will now be described. FIG. 14 illustrates a perspective view of the cigar cutter 300 with a portion of the body 302 hidden for clarity. As shown in FIG. 14, the cradle 306 can include a first cradle portion 316 and a second cradle portion 318. Referring to FIGS. 12-15 together, the first and second cradle portions 316, 318 can each define a part of the receiving portion 308 and can be at least partially positioned within the opening 304 of the body 302. In some embodiments, the first and second cradle portions 316, 318 can be configured to form a receiving portion 308 of the desired shape and size. For example, the first and second cradle portions 316, 318 can form a receiving portion 308 with a quadrilateral-like shape when the first and second cradle portions 316, 318 contact each other (e.g., as shown in FIG. 13). In other examples, the first and second cradle portions 316, 318 can form a receiving portion 308 with a triangular shape, a circular shape, a hexagonal shape, or any other desired shape. In some embodiments, the receiving portion 308 of the cradle 306 is defined by at least three sides and can thereby surround and/or grasp a cigar 20 disposed within the receiving portion 308 by those at least three sides.

As previously described, the cradle 306 can be adjustable between a first position (e.g., as shown in FIG. 12) and a second position (e.g., as shown in FIG. 13). In some of these embodiments, or otherwise, the first and second cradle portions 316, 318 can be independently adjustable so that both the first and second cradle portions 316, 318 can be movable relative to one another. Accordingly, in some of these embodiments, adjusting the first and second cradle portions 316, 318 can thereby adjust the size of receiving portion 308. In some cases, the cradle 306 can include one or more features that assist with adjusting the cradle 306 between the first and second positions. As one example, the cradle 306 can be coupled to one or more biasing members 320 (e.g., a spring) which can bias the cradle 306 into either the first or second position. As illustrated in FIG. 14, both the first and second cradle portions 316, 318 can define one or more channels 322 which can receive a biasing member 320 within. This biasing member 320 can be compressed when the first and/or second cradle portions 316, 318 are in either the first or second position, which can thereby result in the biasing member 320 biasing the first and/or second cradle portions 316, 318 into the second or first position. For instance, in the illustrated embodiment, the biasing members 320 compress against the body 302 when the cradle 306 is in the first position, which results in the cradle 306 being biased from the first position to the second position. As will be described in more detail herein, in some examples, the biasing members 320 can bias the receiving portion 308 into the second position so that the cradle 306 can grasp and secure the cigar 20.

Figure 15:
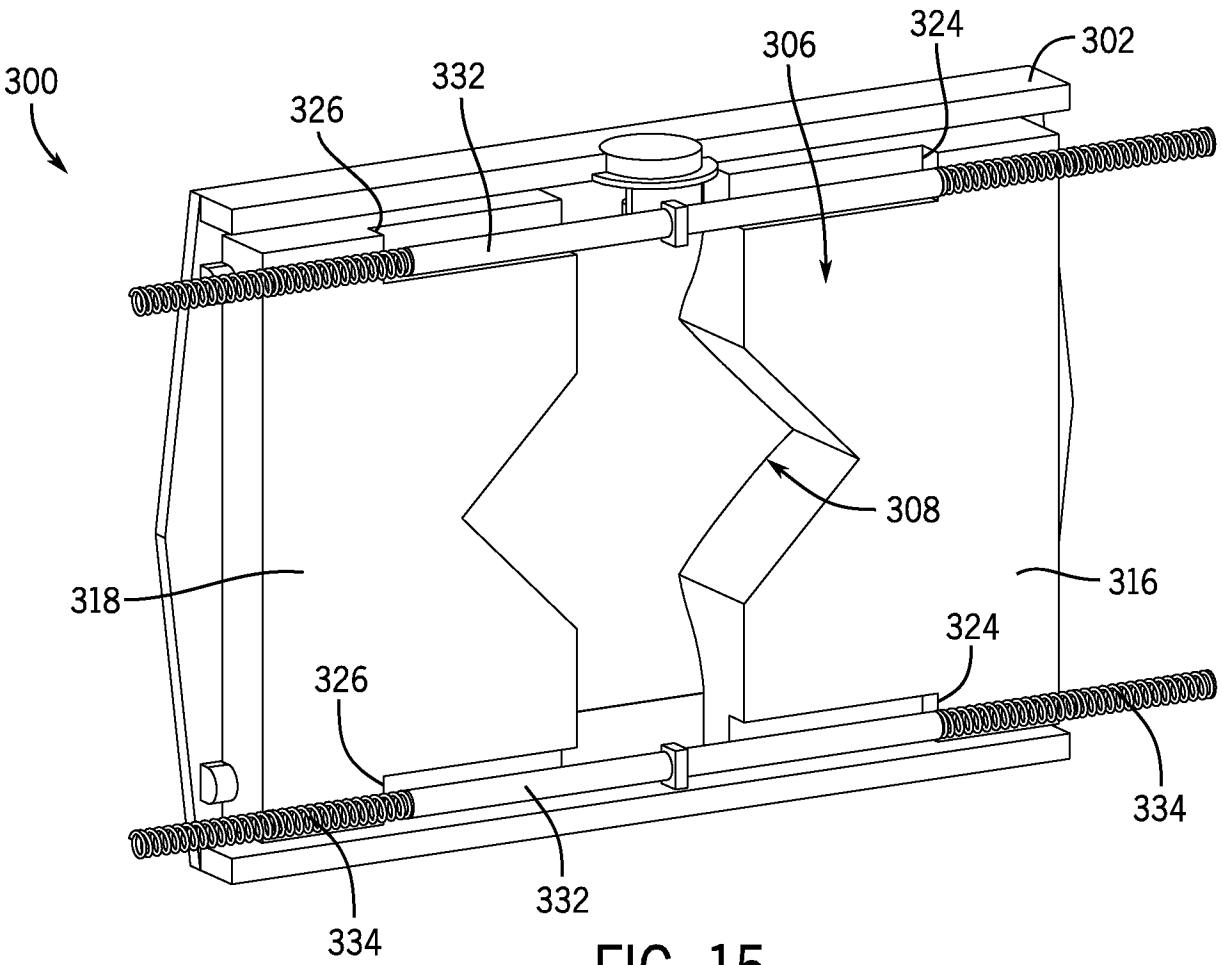
FIG. 15 is a rear perspective view of the cigar cutting device of FIG. 12 with some components hidden for clarity.
Figure 16:
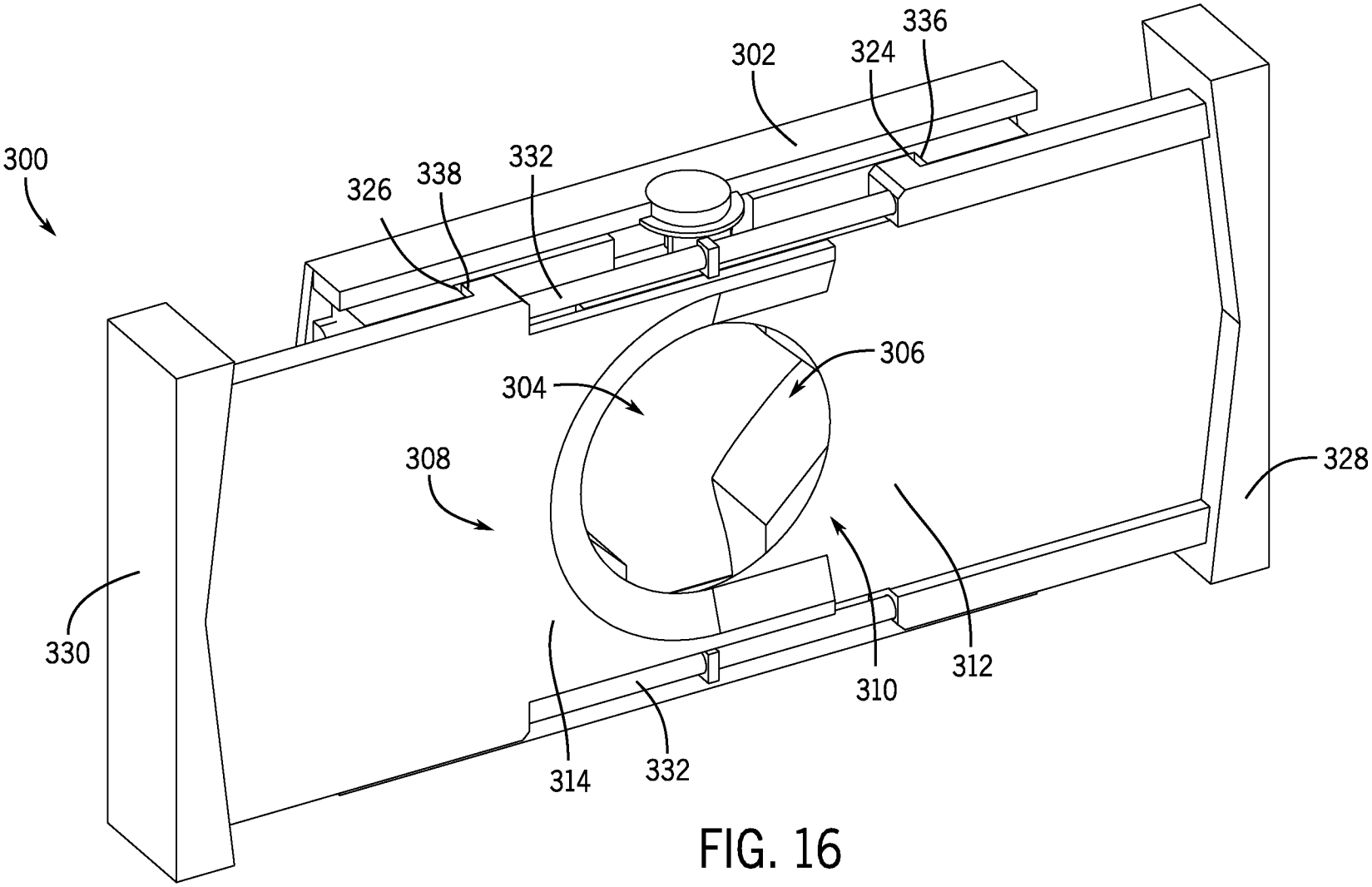
FIG. 16 is a rear perspective view of the cigar cutting device of FIG. 12 with some components hidden for clarity.

In some cases, the cradle 306 can be configured to interface with the cutter portion 310. For example, as shown in FIGS. 15 and 16, the first cradle portion 316 can include a first shoulder 324 and the second cradle portion 318 can include a second shoulder 326, which can each interface with cutter portion 310. The first and second shoulders 324, 326 can be defined by one or more surfaces that can mate with (or otherwise couple to) a separate surface formed on the cutter portion 310. As will be described in more detail herein the first and second shoulders 324, 326 can interface with (or otherwise couple to) the cutter portion 310 so that cradle 306 can be adjusted into the first position (or second position) when the cutter portion 310 is adjusted into the first position (or second position).

Additional details of the cutter portion 310 will now be described. FIG. 16 illustrates a rear perspective view of the cigar cutter 300 with a portion of the body 202 hidden for clarity. As shown in FIG. 16, the first blade portion 312 is coupled to a first handle 328 and the second blade portion 314 is coupled to a second handle 330. The first and second handles 328, 330 can be configured to be grasped by a user so that the user can manually adjust the position of the first and second blade portions 312, 314 (e.g., by laterally moving the first and second handles 328, 330 away and towards the body 302). In some examples, the cutter portion 310 can be coupled to one or more pins 332. The pins 332 can be an elongated member that is coupled to the body 302 and can provide a track for the first and second blade portions 312, 314 to travel across. Furthermore, in some examples, the pins 332 can be coupled to one or more biasing members 334 (as shown in FIG. 15), which can be configured to bias the first and/or second blade portions 312, 314 into the first or second position. For instance, in the illustrated embodiment, the biasing members 334 are a spring that can bias the first and second blade portions 312, 314 from the second position to the first position.

In some examples, the cutter portion 310 can be configured to adjust the positioning of the cradle 306. As shown in FIG. 16, the cutter portion 310 can include a first shoulder 336 formed on the first blade portion 312 and a second shoulder 338 on the second blade portion 314. The first and second shoulders 336, 338 can define a surface which can interface with (or otherwise couple to) a portion of the cradle 306. For instance, the first and second shoulders 336, 338 of the cutter portion 310 can be configured to interface with the first and second shoulders 324, 326 of the cradle 306. Accordingly, in some embodiments, when a user adjusts the cutter portion 310 into the first position (e.g., by grasping and moving the first and second handle 328, 330 away from the body 302), the first and second shoulders 336, 338 of the cutter portion 310 can interface with the first and second shoulders 324, 326 of the cradle 306 and thereby can move the cradle 306 from the second position and into the first position. In some cases, the cutter portion 310 is configured to adjust the cradle 306 into either the first position or the second position, but not both the first and second positions. For example, the first and second shoulders 336, 338 of the cutter portion 310 can exert a force on the first and second shoulders 324, 326 of the cradle 306 to move the cradle 306 into the first position, but do not exert any force on the cradle 306 as the cutter portion 310 moves into the second position. In some of these examples, or otherwise, a gap can be formed between the respective first and second shoulders 324, 326 of the cradle 306 and the first and second shoulders 336, 338 of the cutter portion 310. For instance, the first and second shoulders 324, 326 of the cradle 306 can be spaced apart from the respective the first and second shoulders 336, 338 of the cutter portion when the cutter portion is in the second position. In some examples, moving the cutter portion 310 into the first position from the second position couples the cutter portion 310 to the cradle 306 and moving the cutter portion 310 into the second position from the first position uncouples the cutter portion 310 from the cradle 306.

To assist with forming a desired cut, the first and second blade portions 312, 314 can be formed in any desired shape. For example, as shown in FIG. 16, the first and second blade portions 312, 314 can each define a U-shaped profile. In some embodiments, the first and second blade portions 312, 314 can be spaced apart by an appropriate distance such that the ends of the first and second blade portions 312, 314 define an opening to receive a portion of the cigar 20 therethrough when the cutter portion 310 is in the first position. In some of these embodiments, or otherwise, when transitioned into the second position, the first and second blade portions 312, 314 no longer define an opening and may overlap at least partially.

Figure 17:
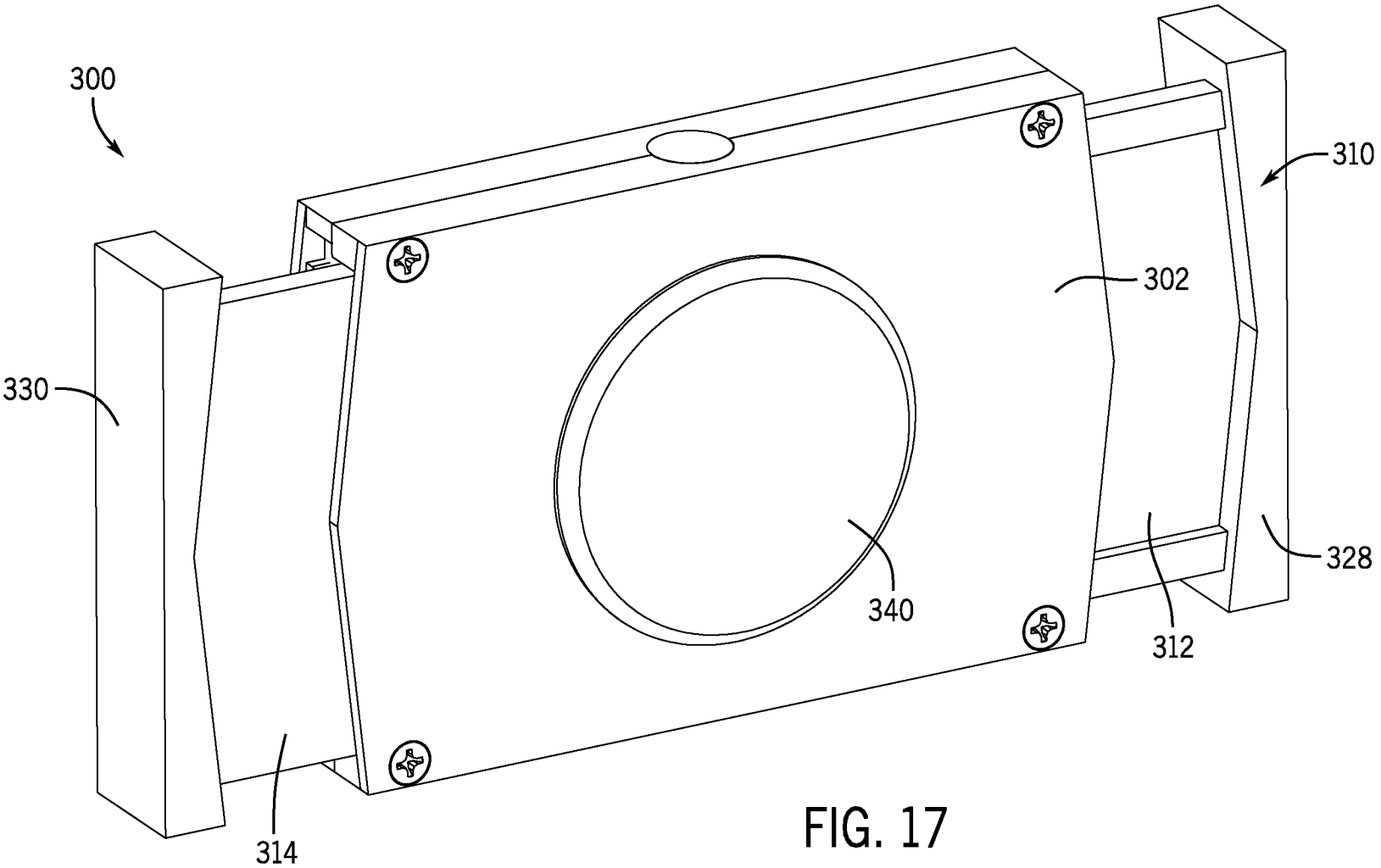
FIG. 17 is a rear perspective view of the cigar cutting device of FIG. 12.

In some embodiments, the cigar cutter 300 can include additional components to assist with cutting the cigar 20 besides those components already described herein (e.g., the cradle 306, the cutter portion 310, etc.). For example, as illustrated in FIG. 17, the cigar cutter 300 can include a stop 340. The stop 340 can couple to a rear portion of the body 302 so that the stop is positioned adjacent the opening 304 of the body 302. The stop 340 can be spaced apart from the body 302 by any desired distance. Positioning the stop 340 in this manner can provide a surface upon which the cap 32 of the cigar 20 can abut, which thereby can assist a user in positioning the cigar 20 at the desired depth within the cigar cutter 300.

Referring to FIGS. 12-17, an example operation of the cigar cutter 300 will now be described. In order to cut a cigar 20 with the cigar cutter 300, a user can first position the cigar cutter 300 into the first position. In some examples, the user can position the cigar cutter 300 in the first position by moving the first and second handles 328, 330 of the cutter portion 310 away from the body 302. Moving the first and second handles 328, 330 in this manner can result in the first and second blade portions 312, 314 to also move away from the body 302 so that the first and second blade portions 312, 314 form define an opening. Furthermore, by adjusting the cutter portion 310 into the first position, the first and second shoulders 336, 338 of the cutter portion 310 can interface with the first and second shoulders 324, 326 of the cradle 306, resulting in the cradle 306 transitioning into the first position (e.g., adjusting the cutter portion 310 into the first position couples the cutter portion 310 with the cradle 306).

With the cigar cutter 300 in the first position, a user can insert a cigar 20 within the opening 304 defined by the body 302 of the cigar cutter 300. In some examples, the cigar 20 can be positioned within the opening 304 such that the cap 32 of the cigar 20 abuts the stop 340 coupled to the body 302 of the cigar cutter, which can thereby indicate the cigar 20 is positioned at the desired depth.

After placing the cigar 20 within the opening 304 of the cigar cutter 300, the user can begin to adjust the cigar cutter 300 from the first position to the second position. The user can begin this transition by pressing the first and second handles 328, 330 of the cutter portion 310 towards the body 302 of the cigar cutter 300. As the cutter portion 310 transitions into the second position, the cradle portion 306 can also transition into the second position. For example, the biasing members 320 can bias the cradle 206 into the second position. In some instances, with the cigar 20 positioned in the opening 304, the first and second cradle portions 316, 318 can press against the outer surface of the cigar 20 via the receiving portion 308, which can align the cigar 20 with the cigar cutter 300 such that the longitudinal axis of the cigar 20 is substantially perpendicular to the opening 304 of the body 302. Additionally, the receiving portion 308 can contact the cigar 20 at four points of contact (e.g., for each side defined by the receiving portion 308), which can secure the cigar 20 properly within the cigar cutter 300. Furthermore, transitioning the cutter portion 310 from the first position to the second position can uncouple the cutter portion 310 from the cradle 306. This arrangement can ensure an adequate amount of force is applied to the cigar 20 via the cradle 306 as no additional force is transferred to the cigar 20 via the movement of the cutter portion 310.

To finish the cut, the user can continue moving the cuter portion 310 until the cutter portion contacts the sides of the body 302 and thereby reaches the second position. In this arrangement, the first and second blade portions 312, 314 can overlap with one another, which ensure that the first and second blade portions 312, 314 travel through the cigar 20 to make the desired cut.

While illustrative embodiments have been illustrated and described, it will be appreciated that various changes can be made therein without departing from the spirit and scope of the disclosure.

I claim:

1. A method of using a cigar cutter, comprising:

positioning a cutter portion of the cigar cutter in a first position, where the cigar cutter includes:

a body defining an opening for receiving at least a portion of a cigar;

the cutter portion coupled to the body and including a blade configured to cut the cigar, wherein the cutter portion is adjustable between the first position, where the blade is spaced apart from the opening of the body, and a second position, where the blade is configured to cut the cigar;

a cradle movably coupled to the cutter portion and defining an opening for facilitating alignment of the cigar, wherein the cradle is adjustable between a first position, where the opening of the cradle is at a first width, and a second position, where the opening of the cradle is at a second width, wherein the second width is less than the first width, and wherein the cutter portion is configured to adjust the cradle into the first position when the cutter portion is adjusted into the first position;

a first biasing member coupled to the cutter portion, wherein the first biasing member is configured to bias the cutter portion into the first position; and a second biasing member coupled to the cradle, wherein the second biasing member is configured to bias the cradle into the second position, wherein the first biasing member and the second biasing member are positioned in parallel planes;

inserting the cigar into the opening of the body; and adjusting the cutter portion from the first position to the second position to cut the cigar.

2. The method of claim 1, wherein the cutter portion includes a first shoulder and the cradle includes a second shoulder, the first shoulder being configured to interface with the second shoulder when the cutter portion is in the first position.

3. The cigar of claim 2, wherein positioning the cutter portion of the cigar cutter in the first position includes interfacing the first shoulder of the cutter portion with the second shoulder of the cradle.

4. The cigar of claim 2, wherein the first shoulder of the cutter portion is spaced apart from the second shoulder of the cradle when adjusting the cutter portion from the first position to the second position.

5. The method of claim 1, wherein the cradle is configured to press against at least a portion of the cigar when adjusting the cutter portion from the first position to the second position.

6. A cigar cutting device, comprising:

a body defining an opening for receiving at least a portion of a cigar;

a cutter portion coupled to the body and including a blade configured to cut the cigar, wherein the cutter portion is adjustable between a first position, where the blade is spaced apart from the opening of the body, and a second position, where the blade is configured to cut the cigar;

a cradle movably coupled to the cutter portion and defining a receiving portion for facilitating alignment of the cigar, wherein the cradle is adjustable between a first position, where the receiving portion is at a first width, and a second position, where the receiving portion is at a second width, wherein the second width is less than the first width, and wherein the cutter portion is configured to adjust the cradle into the first position when the cutter portion is adjusted into the first position;

a first biasing member coupled to the cutter portion, wherein the first biasing member is configured to bias the cutter portion into the first position; and a second biasing member coupled to the cradle, wherein the second biasing member is configured to bias the cradle into the second position, wherein the first biasing member and the second biasing member are positioned in parallel planes.

7. The cigar cutting device of claim 6, wherein the cutter portion includes a first shoulder and the cradle includes a second shoulder, the first shoulder being configured to interface with the second shoulder when the cutter portion is in the first position.

8. The cigar cutting device of claim 7, wherein the first shoulder of the cutter portion is spaced apart from the second shoulder of the cradle when the cutter portion is in the second position.

9. The cigar cutting device of claim 6, wherein the receiving portion of the cradle is defined by at least three sides.

10. The cigar cutting device of claim 8, wherein the receiving portion of the cradle forms a quadrilateral shape.

11. The cigar cutting device of claim 6, further comprising a stop removably coupled to the body, wherein the stop defines an end of the opening of the body.

* * * * *